US005466563A

United States Patent [19]

Ishikawa et al.

[11] Patent Number: 5,466,563

[45] Date of Patent: Nov. 14, 1995

[54] METHOD OF PROCESSING SILVER HALIDE PHOTOGRAPHIC MATERIAL

[75] Inventors: Takatoshi Ishikawa, Minami-ashigara, Japan; Bryan A. I. Snelling, Overijse, Belgium

[73] Assignee: Fuji Photo Film Co., Ltd., Minami-ashigara, Japan

[21] Appl. No.: 798,135

[22] Filed: Nov. 26, 1991

[30] Foreign Application Priority Data

Nov. 27, 1990 [JP] Japan ..... 2-324606
Nov. 27, 1990 [JP] Japan ..... 2-324607

[51] Int. Cl.[6] ..... G03C 5/31; G03C 5/395

[52] U.S. Cl. ..... 430/398; 430/399; 430/400; 430/30; 354/319; 354/322

[58] Field of Search ..... 430/398, 399, 430/400, 30; 354/319, 322

[56] References Cited

U.S. PATENT DOCUMENTS

| | | | |
|---|---|---|---|
| 4,828,968 | 5/1989 | Okutsu et al. | 430/398 |
| 4,999,660 | 3/1991 | Wright | 354/322 |
| 5,004,676 | 4/1991 | Meckl et al. | 430/398 |
| 5,077,180 | 12/1991 | Yoshida et al. | 430/399 |
| 5,124,239 | 6/1992 | Fujita et al. | 430/398 |

FOREIGN PATENT DOCUMENTS

| | | | |
|---|---|---|---|
| 0157214 | 10/1985 | European Pat. Off. | 354/319 |
| 0173203 | 3/1986 | European Pat. Off. . | |
| 0416585 | 3/1991 | European Pat. Off. | 430/399 |
| 0430245A1 | 6/1991 | European Pat. Off. . | |
| 2602151 | 8/1977 | Germany . | |

OTHER PUBLICATIONS

Patent Abstracts of Japan, vol. 5, No. 191 (P–92)(863) 5 Dec. 1981.

Jeno Paizs, "How To Minimize Developer Consumption", Jul. 1984, vol. 66, No. 7, pp. 320–324, British Kinematography Sound and Television Society Journal.

Patent Asbtracts of Japan, vol. 14, No. 54 (P–999)(3997) 31 Jan. 1990.

*Primary Examiner*—Charles L. Bowers, Jr.
*Assistant Examiner*—Mark F. Huff
*Attorney, Agent, or Firm*—Burns, Doane, Swecker & Mathis

[57] ABSTRACT

A method of processing silver halide photographic material comprises the steps of passing a belt for conveying an imagewise exposed silver halide photographic material through the processing tanks, carrying the silver halide photographic material on the belt and processing the silver halide photographic material conveyed by the belt in the processing tanks while replenishing the tanks with constant amounts of replenishing solutions respectively, wherein the method comprises detecting a level of developing solution in development tank and supplying the development tank with an additional fresh developing tank solution or overflow solution from the development tank when said level of developing solution in the tank falls to a predetermined level. This method makes it possible to reduce an amount of the processing solution waste to be drained from the processing machine.

16 Claims, No Drawings

METHOD OF PROCESSING SILVER HALIDE PHOTOGRAPHIC MATERIAL

BACKGROUND OF THE INVENTION

The present invention relates to a method of processing a silver halide photographic material. Specifically, it relates to a method of processing a silver halide photographic material, in which the amount of the waste liquid from the processing solution used is reduced or eliminated so that the method does not cause environmental pollution. Additionally, the method yields processed photographic materials having extremely stable photographic characteristics.

In continuously processing a silver halide photographic material, especially with a large-sized processing machine, a method is generally employed in the processing machine in which a replenisher having a high activity is replenished to the processing tank containing a tank solution in accordance with the amount of the photographic material processed. In the method, the tank solution overflows a so-called overflow solution in accordance with the amount of the replenisher added to the processing tank. The overflow solution is drained away from the processing system. The drained solution is recovered and treated as a waste solution. This waste solution, however, has a large environmental pollution load value. Therefore, drainage of such a waste solution is unfavorable for the protection of environment against environmental pollution or disruption. Additionally, the cost of recovery and treatment of the waste solution is significant.

Under the circumstances, heretofore, various techniques of reducing the amount of the waste solution have been investigated in this technical field. As one example, a method of removing the accumulated and excess components, if any, from the overflow solution by supplementing the solution with the deficient components followed by re-using the thus treated overflow solution as a replenishment has been investigated in various ways. The method is generally called a "regenerating method" for regenerating processing solutions and is applied to various developers, bleaching solutions and fixing solutions. In the recovering method, however, maintenance of the quality of the regenerated replenisher is extremely difficult as quality is greatly influenced by the life history of the overflow solution. Additionally, since the processing solutions need quality control by various analysis in the regenerating method, the method is practicable only in laboratories having a high-level technical capabilities. In addition to such severe labor constraints on carrying out regeneration, the quality of the regenerated replenisher is generally unstable as compared with that of a non-regenerated system replenisher. Accordingly, the method itself is extremely limited and could not be said to be popular.

On the other hand, as an example of a technique of reducing the amount of the waste solution to be drained, a method of reducing the amount of the replenisher itself to be replenished to the processing system is known. In order to reduce the amount of the replenisher, it is necessary to solve the related technical problems of how to remove the influence of the accumulated components on the processed photographic material, how to prepare a concentrated replenisher, and how to improve the stability of the processing solution being used. For instance, techniques of reducing the amount of the replenisher to a color developer have been disclosed in JP-A-61-70552 and 1- 105948 (The term "JP-A" as used herein means an "unexamined published Japanese patent application".). In the proposed low-replenishment system process, if the amount of the waste solution to be drained is comparable to or less than the amount of the replenisher necessary for regeneration, then the process would be universally applicable and more desirable because no special technology would be necessary.

In particular, in accordance with the proposed process, the amount of the replenisher to be replenished to the color developer of the first bath is same as the amount of the carry-over solution (which is to be carried over to the next bath along with the photographic material being processed) while the evaporated portion is corrected by adding water to the bath. Accordingly, the process is carried out, theoretically yielding no overflowed solution during processing. That is, the process yields no waste solution during processing.

However, it has been found that the above-mentioned ultra-low-replenishment system process of yielding no waste solution during processing causes formation of an overflow solution from the color developer, or on the contrary, causes lowering of the liquid level of the processing tank and, as a result, the process could not be carried out stably. In particular, lowering of the liquid level of the processing tank directly results in fluctuation of the processing time (or shortening the processing time) which causes not only deterioration of the quality of the processed photographic material but also has a bad influence on the heater and circulation system, etc., of the processing machine. The present inventors investigated the reasons for such problems, and, as a result, have found that the problems are caused by the fluctuation of the amount of the carry-over solution per unit amount of the photographic material processed. Precisely, in the processing machine of conveying the photographic material being processed by the use of a leader belt, the amount of the carry-over solution to be carried over by the leader belt must be taken into consideration (Though depending upon the material of the leader belt and the linear velocity thereof, the amount of the carry-over solution with the leader belt is generally from 1 to 3 ml per meter of the leader belt.). However, since the leader belt is not active in the processing solution, generally no replenisher is replenished to the system during conveyance of leader belt. In this situation, the processing machine is driven and run under various conditions in laboratories. Accordingly, it has been found that the amount of the leader belt to be conveyed for processing photographic material of a unit area varies in accordance with the running condition of the processing machine as to whether the machine is run without processing photographic materials, or as to whether only one line or two lines of photographic materials are set on the leader belt. As a result, the amount of the carry-over solution varies in accordance with the various running conditions.

Therefore, in carrying out the above-mentioned ultra-low-replenishment system process, the technique of maintaining the processing solution at a constant level in the processing tank is important.

SUMMARY OF THE INVENTION

Accordingly, an object of the present invention is to provide a method of processing a silver halide photographic material in which the amount of the processing solution waste to be drained from the processing machine is noticeably reduced. According to the process, the amount of the replenisher to be replenished to the processing machine is reduced while the property of the processing solution to be used during the process is stable.

It has been found that the above-mentioned object is attained by method of continuous processing silver halide photographic material comprising the steps of processing an imagewise exposed silver halide photographic material in processing tanks while replenishing the processing tanks with constant amounts of replenishing solutions per unit area of the silver halide photographic material, respectively, wherein the method comprises detecting a level of processing solution in one of the processing tanks and supplying the processing tank with an additional processing solution when said level of processing solution falls to a predetermined level.

In one (first) embodiment a fresh tank solution which is fresh processing solution is used as the additional processing solution.

In another (second) embodiment, a overflow solution which is overflowed from the processing tank which is recovered and stored in a stock tank is used as the additional processing solution.

In another embodiment, the silver halide photographic material is one containing a high-silver chloride emulsion and the processing solution is a color developer.

In another embodiment the amount of the replenisher to be replenished to the processing system is same as or less than the mean amount carried-over from the processing tank to the subsequent stage of the process.

In yet another embodiment the amount of the replenisher to be replenished is from 30–100 ml per $m^2$ of photographic material being processed.

In carrying out the processing method of the present invention according to yet another preferred embodiment, the amount of the processing solution is determined, and when the liquid level in the processing tank lowers to a certain amount, a fresh tank solution and replenisher are separately and automatically added to the processing tank separately.

Further objects, features and advantages of the present invention will become apparent with respect to the Detailed Description of Preferred Embodiments which follows, when read in light of the illustrative examples.

DETAILED DESCRIPTION OF THE PREFERRED EMBODIMENTS

In the process of the present invention, the term "fresh tank solution" means a processing solution to be charged in a processing tank at the starting time of the processing, and during and after the processing the tank solution is indicated as working solution. In this connection, the conventional replenisher for the processing tank is indicated as replenisher or replenishing solution. The fresh tank solution is also used to compensate the reduction in the level of working solution in the processing tank in the first embodiment of the present invention. The term "overflow solution" means a solution which is overflowed from the processing tank. The term "tank solution" means a processing solution which is contained in the processing tank and encompasses the fresh tank solution and working solution.

As a processing machine for carrying out the method of the present invention, a photographic processer is preferred, which is equipped with a processing tank, a replenisher tank, a stock tank for fresh tank solution or a stock tank for overflow solution, a sensor for sensing the liquid level in the processing tank, and a means for feeding a fresh tank solution or overflow solution to the processing tank.

The processing method of the present invention may be applied to any and every processing bath, i.e. tank (for example, color development, black-and-white development, bleaching, fixation, bleach-fixation, and stabilization). In view of the object of reducing the amount of the waste solution from the processing device, the method is the most effectively applied to the first bath of the processing procedure. Specifically, it is effective to apply the processing method of the present invention to a black-and-white developer in the black-and-white processing step or color-reversal step or to a color developer in the color processing step. More specifically, it is preferred to apply the processing method of the present invention to the process of processing color printing photographic materials where the mean carry-over amount is relatively large. In this case, the carry-over amount means the total amount of the working solution which is to be carried over to the next bath (tank) along with the photographic material being processed, the conveying means such as leader belts and the like from the processing tank, for example, based on absorption by the photographic material and adsorption by the photographic material, the conveying means and guide therefor. If the mean replenisher amount to the first bath is less than the mean carry-over amount thereto, substantial waste-free processing would be theoretically possible because of the influence of evaporation or the like. However, as mentioned above, since the carry-over amount varies in accordance with the processing conditions, it is an important object to control the overflow amount and the lowering of the liquid level in the processing tank.

The mean carry-over amount is a value obtained by dividing an amount of working solution carried over from one tank, for example, from a development tank, in certain period of time by an amount of the photographic materials processed in the certain period of time in the tank. The mean carry-over amount may easily be determined by those skilled in the art. For instance, the carry-over amount can be determined by determining the increase in the weight of the photographic material being processed and that of the leader belts being used; by subtracting the total overflow amount from the total replenisher amount per unit time; or by determining the amount by which the liquid level is lowered per unit of photographic material being processed when the material is processed without replenishment.

As mentioned above, in order to constantly and stably maintain the waste-free processing condition, it is preferred that the replenisher amount is defined to be smaller than the mean carry-over amount. For instance, the replenisher amount is especially preferably from 0.99 to 0.70 times, more preferably from 0.95 to 0.80 times the mean carry-over amount. Specifically, the replenisher is from 30 to 100 ml, preferably from 30–90 ml, and more preferably from 40 to 85 ml, per $m^2$ of the photographic material being processed. By automatically supplying a fresh tank solution to the processing tank in an amount to compensate for the lowered liquid level of the tank under the condition, the liquid level of the tank may well be controlled to a desired level. If only water is added to compensate for the lowered liquid level of the tank, the working solution would be disadvantageously diluted excessively to have some adverse influence on the photographic characteristics of the processed material.

In the first-embodiment, the fresh tank solution and replenishing solution are different in their formulation. For example, replenishing solution for developing solution contains a developing agent and preservative such as sulfites, hydroxyamines and their derivatives in high concentration, a halide in a low concentration, and has a high pH value, compared with those of the fresh developing tank solution. In this respect, it is preferable that the differences between the replenishing solution for developing solution and the fresh developing tank solution in those concentrations be not less than 1 g/l, not less than 1 g/l, not less than 0.1 and not less than 0.02 mole/l with respect to developing agent, preservative, pH and halide, respectively. Specifically, Examples mentioned later will illustrate the fresh tank solution and replenishing solution.

The first embodiment employs replenishing a replenisher to a tank and also supplying the tank with fresh tank solution. In this connection, the replenishers are replenished to respective tanks in accordance with an amount of the photographic materials processed in a certain period when the photographic materials are processed. In other words, the replenishers are not replenished to the respective tanks when the photographic materials are not processed. Even when the photographic materials are not processed, it is general that the conveying means such as leader belts does not stop, but still works. Therefore, the replenisher is used to mainly compensate for consumpsion of active ingredients contained in the working solution and also to compensate for some extent of the loss of working solution based on absorption by the photographic material and adsorption by the photographic material, the conveying means and guide therefor. The replenisher may be replenished to the processing tank continuously or intermittently.

Even if the replenisher is replenished to the processing tank during the processing of the photographic materials, the reduction in the level of the working solution contained in the tank practically occurs. In this respect, the level down is considered to occur due to change in the amount of carry-over and vaporization of the working solution. Therefore, the fresh tank solution is used to compensate for the level down of the working solution contained in the tank, so that the fresh tank solution is not supplied to the tank in accordance with the amount of the photographic materials which are processed in the tank, but is supplied to the tank when the level of the working solution in the processing tank lowers the predetermined level. Accordingly, the supplying of the fresh tank solution is different from the replenishing of the replenisher. Since such level down is remarkable in case where an amount of the replenisher is small or intermittently conducted, the present invention is effectively applied to such case and thereby, changes in the photographic properties of the processed photographic materials are greatly reduced.

Next, the processing solution to be used in the present invention will be explained in detail.

The developer to be used in the present invention may be either a black-and-white developer or a color developer. The former black-and-white developer may contain any conventional black-and-white developing agent, for example, a dihydroxybenzene such as hydroquinone or hydroquinone monosulfonic acid salt; 3-pyrazolidones such as 1-phenyl-3-pyrazolidone; or aminophenols such as N-methyl-p-aminophenol. The developer may contain one or more of the above agents.

The color developer preferably contains an aromatic primary amine type color-developing agent. As the agent, p-phenylenediamine compounds are preferably used, though aminophenol compounds may also be used. Specific examples of the preferred compounds include 3-methyl-4-amino-N,N-diethylaniline, 3-methyl-4-amino-N-ethyl-N-β-hydroxyethylaniline, 3-methyl-4 -amino-N-ethyl-N-β-methanesulfonamidoethylaniline, 4-amino-N-ethyl-N-hydroxyethylaniline and their sulfates, hydrochlorides, phosphates, oxalates and p-toluenesulfonates. These developer may contain one or more of these developing agents.

The developer to be used in the present invention may contain various preservatives (antioxidants). In general, sulfites and hydroxylamine are known to be used as a preservatives in the developer. Additionally, various organic preservatives may also be used. Preferred examples of usable preservatives are hydroxylamine derivatives such as diethylhydroxylamine, N,N-dimethoxyethylhydroxylamine, N,N-disulfoethylhydroxylamine, N,N-dicarboxyethylhydroxylamine and N, N-diphosphonoethylhydroxylamine; hydrazines such as N,N-dicarboxymethylhydrazine, sulfoethylhydrazine and sulfopropylhydrazine; alkanolamines such as triethanolamine and diethanolamine; and catechols such as catechol-3,5-disulfonic acid and catechol-3,5,6-trisulfonic acid. The amount of the preservative in the developer is from 0.1 g to 30 g, preferably from 0.5 g to 15 g, per liter of the developer.

In the process of the present invention, it is effective to use a developing solution (a solution of fresh developing tank solution and its replenisher) containing a small amount of sulfites, preferably substantially no sulfites. In addition, the developing solution containing a small amount of unsubstituted hydroxyamine, preferably substantially no the hydroxyamine is effective.

The developer used in the present invention preferably has a pH value of from 9 to 12, more preferably from 9.5 to 11.

In order to maintain the pH value of the developer within the above-mentioned range, it is preferred to incorporate various buffers into the developer. As examples of buffers usable for this purpose, one can mention carbonates, phosphates, borates, tetraborates, hydroxybenzoates, glycyt salts, N,N-dimethylglycine salts, leucine salts, norleucine salts, guanien salts, 3,4-dihydroxyphenylalanine salts, alanine salts, aminobutyrates, 2-amino-2-methyl-1,3-propanediol salts, valine salts, proline salts,-trishydroxyaminomethane salts, and lysine salts. Especially preferred are carbonates, phosphates, tetraborates and hydroxybenzoates, since they have a high solubility and an excellent buffering capacity in a high pH range of 9.0 or more. Additionally, even when buffers are added to developers, they do not have any adverse influence on the photographic materials to be processed with the developer (e.g., fog). Further, they are inexpensive. Therefore, use of such buffers is especially preferred for maintaining pH.

Examples of preferred buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, these compounds are not intended to be limiting.

The amount of the buffer to be added to the developer for use in the present invention is preferably 0.1 mol/liter or more, especially preferably from 0.1 mol/liter to 0.4 mol/liter.

Additionally, the developer may contain various chelating agents as an agent for preventing precipitation of calcium or magnesium or for the purpose of improving the stability of the developer. For instance, usable chelating agents include nitrilotriacetic acid, diethylenetriamine-pentaacetic acid, ethylenediamine-tetraacetic acid, N,N,N-trimethylenephosphonic acid, ethylenediamine-N,N,N',N'-tetramethylenesulfonic acid, transcyclohexanediamine-tetraacetic acid, 1,2-diamino-propanetetraacetic acid, glycolether-diamine-tetraacetic acid, ethylenediamine-orthohydroxyphenylacetic acid, 2 -phosphonobutane-1,2,4-tricarboxylic acid, 1-hydroxyethylidene-1,1 -diphosphonic acid, and N,N'-bis(2-hydroxybenzyl) ethylenediamine-N,N'-diacetic acid.

If desired, two or more of these chelating agents may be incorporated into the developer.

The amount of the chelating agent to be in the developer may be an amount sufficient for sequestering metal ions in the developer. For instance, it may be from 0.1 g to 10 g or so per liter of developer. The developer may optionally contain any desired development accelerator.

As examples of usable development accelerators, there are mentioned thioether compounds described in JP-B-37-16088, 37- 5987, 38-7826, 44-12380 and 45-9019 (the term "JP-B" as used herein means an "examined Japanese patent publication") and U.S. Pat. No. 3,813,247; p-phenylenediamine compounds described in JP-A- 52-49829 and 50-15554; quaternary ammonium salts described in JP-A-50-137726, JP-B-44-30074, JP-A-56-156826 and 52-43429; amine compounds described in U.S. Pat. Nos. 2,494,903, 3,128,182, 4,230,796, 3,253,919, JP-B-41-11431, U.S. Pat. Nos. 2,482,546, 2,596,926 and 3,582,346; polyalkylene oxides described in JP-B-37-16088 and 42-25201, U.S. Pat. No. 3,128,183, JP-B-41-11431 and 42-23883 and U.S. Pat. No. 3,532,501; as well as 1-phenyl-3-pyrazolidones, and imidazoles.

The developer for use in the present invention may optionally contain an antifoggant, if desired. As the antifoggant, for example, alkali metal halides such as sodium chloride, potassium bromide and potassium iodide, as well as organic antifoggants can be used. Specific examples of usable organic antifoggants are nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2 -thiazolylmethyl-benzimidazole, indazole, hydroxyazaindolidine and adenine.

The developer for use in the present invention preferably contains a chloride ion for the purpose of reducing stains in the processed materials and of elevating the coloring capacity of the materials. Preferably, the content of chloride ion in the developer is 0.035 mol/liter or more, especially preferably from 0.04 to 0.15 mol/liter.

The chloride ion may be added directly to the developer or it may be leached out from the photographic material being processed into the developer during development procedure.

In the former case of directly adding chloride ion to the developer, a chloride ion-donating substance is added to the developer. Examples of the substances are sodium chloride, potassium chloride, ammonium chloride, lithium chloride, nickel chloride, magnesium chloride, manganese chloride, calcium chloride and cadmium chloride. Preferred among the chloride-ion donating substances are sodium chloride and potassium chloride.

As the case may be, chloride ion may be released from the brightening agent as added to the developer.

A bromide ion may also be added to the developer for the same purpose. As a bromide ion-donating substance usable in the developer, there are mentioned, for example, sodium bromide, potassium bromide, ammonium bromide, lithium bromide, calcium bromide, magnesium bromide, manganese bromide, nickel bromide, cadmium bromide, cerium bromide and thallium bromide. Preferred sources of bromide ions are potassium bromide and sodium bromide.

Where the chloride ion or bromide ion is released from the photographic material being processed during development procedure, the ion may be released from the emulsion or from something other than the emulsion.

The developer to be used in the present invention preferably contains a brightening agent. Preferred brightening agents are 4,4'-diamino-2,2'-disulfostilbene compounds. The amount of the agent to be added to the developer may be from 0 to 5 g/liter, preferably from 0.1 to 4 g/liter.

If desired, the developer may further contain various surfactants such as alkylsulfonic acids, arylsulfonic acids, aliphatic carboxylic acids or aromatic carboxylic acids.

The processing-temperature of the processing method of the present invention of using a developer may be from 20° to 50° C., preferably from 30° to 40° C. The processing time may be from 20 seconds to 5 minutes, preferably from 30 seconds to 2 minutes. The amount of the replenisher is preferably small, in carrying out the method of the present invention. Suitably, it may be from 10 to 400 ml, preferably from 20 to 300 ml, per $m^2$ of the photographic material being processed. Most preferably, it is from 40 ml to 85 ml per $m^2$ of the material.

Next, the desilvering process to be applied to the method of the present invention will be mentioned below. The desilvering process may be anyone of a fixation step, a combination of a bleaching step and a fixation step, a combination of a fixation step and a bleach-fixation step, a combination of a bleaching step and a bleach-fixing step, and a bleach-fixation step.

Next, a bleaching solution, a bleach-fixing solution and a fixing solution which may be employed in carrying out the method of the present invention will be mentioned below.

Any known bleaching agent may be used in the bleaching solution or bleach-fixing solution of the present invention. Especially preferred as the bleaching agent are organic complexes of iron(III) (for example, iron(III) complexes with aminopolycarboxylic acids such as ethylenediamine-tetraacetic acid or diethylenetriamine-pentaacetic acid, or with aminopolyphosphonic acids, phosphonocarboxylic acids or organic phosphonic acids); or organic acids such as citric acid, tartaric acid or malic acid; persulfates; or hydrogen peroxide.

Among the bleaching agents, organic complexes of iron(III) are most preferred because they are suitable for rapid processing and do not pollute the environment. Aminopolycarboxylic acids, aminopolyphosphonic acids, organic phosphonic acids and salts thereof are useful for forming organic complexes of iron(III). Specifically one can mention ethylenediaminetetraacetic acid, diethylenetriamine-pentaacetic acid, 1,3-diaminopropanetetraacetic acid, propylenediaminetetraacetic acid, nitrilo-triacetic acid, cyclohexanediaminetetraacetic acid, methyliminodiacetic acid, iminodiacetic acid, and glycol ether diamine-tetraacetic acid. These compounds may be in the form of sodium, potassium, lithium or ammonium salts. Among these compounds, iron(III) complexes of ethylenediaminetetraacetic acid, diethylene-triamine-pentaacetic acid, cyclohexanediamine-tetraacetic acid, 1,3-diaminopropanetetraacetic acid and methyliminodiacetic acid are preferred, because of their high bleaching capacity.

The ferric complex may directly be added to the solution as the complex itself; or alternatively, a ferric salt such as ferric sulfate, ferric chloride, ferric nitrate, ammonium ferric sulfate or ferric phosphate may be added to the solution together with a chelating agent such as an aminopolycarboxylic acid, aminopolyphosphonic acid or phosphonocarboxylic acid and ferric complex may be formed in the solution. The amount of the chelating agent may be over the necessary amount for forming the intended ferric complex. Among ferric complexes, aminopolycarboxylate/ferric complexes are preferred, and the amount thereof to be added to the solution is from 0.01 to 1.0 mol/liter, more preferably from 0.05 to 0.50 mol/liter.

The bleaching solution, the bleach-fixing solution and/or the previous bath thereof may contain various compounds as a bleaching accelerator. For instance, mercapto group- or disulfido bond-having compounds described in U.S. Pat. No. 3,893,858, West German Patent 1,290,812, JP-A-53-95630 and *Research Disclosure,* Item No. 17129 (July, 1978); thiourea compounds described in JP-B-45-8506, JP-A-52-20832, 53-32735 and U.S. Pat. No. 3,706,561; as well as halides such as iodides or bromides are preferred as the bleaching accelerator, as having an excellent bleaching-accelerating capacity.

In addition, the bleaching solution of bleach-fixing solution which may be employed in the present invention may further contain a re-halogenating agent such as bromide (for example, potassium bromide, sodium bromide, ammonium bromide), chlorides (for example, potassium chloride, sodium chloride, ammonium chloride), or iodides (for example, ammonium iodide). If desired, the solution may further contain one or more inorganic acids or organic acids or alkali metal or ammonium salts thereof which have a pH-buffering capacity, such as borax, sodium metaborate, acetic acid, sodium acetate, sodium carbonate, potassium carbonate, phosphorus acid, phosphoric acid, sodium phosphate, citric acid, sodium citrate or tartaric acid, as well as an antiseptic such as ammonium nitrate or guanidine.

A known fixing agent can be employed in the bleach-fixing solution or fixing solution for use in the present invention. As the fixing agent, one or more water-soluble silver halide solubilizers can be used, which include, for example, thiosulfates such as sodium thiosulfate or ammonium thiosulfate; thiocyanates such as sodium thiocyanate or ammonium thiocyanate; thioether compounds such as ethylenebisthioglycolic acid or 3,6-dithia-1,8-octanediol; and thioureas. A particular bleach-fixing solution containing the fixing agent described in-JP-A-55-155354 together with a large amount of a halide such as potassium iodide can also be used. In the present invention, thiosulfates, especially ammonium thiosulfate, are preferably used. The amount of the bleaching agent in the solution is preferably from 0.3 to 2 mol/liter, more preferably from 0.5 to 1.0 mol/liter. The pH range of the bleach-fixing solution or fixing solution for use in the present invention is preferably from 3 to 10, more preferably from 5 to 9.

The bleach-fixing solution may further contain other various brightening agents, defoaming agents or surfactants as well as organic solvents such as polyvinyl pyrrolidone or methanol.

The bleach-fixing solution or fixing solution contains, as a preservative, a sulfite ion-releasing compound such as a sulfite (e.g., sodium sulfite, potassium sulfite, ammonium sulfite), a bisulfite (e.g., ammonium bisulfite, sodium bisulfite, potassium bisulfite), or a metabisulfite (e.g., potassium metabisulfite, sodium metabisulfite, ammonium metabisulfite). The compound is preferably incorporated into the solution in an amount of approximately from 0.02 to 0.50 mol/liter, more preferably approximately from 0.04 to 0.40 mol/liter, as the sulfite ion.

As the preservative, addition of sulfites is usual, but other ascorbic acid, carbonyl-bisulfite adducts or carbonyl compounds may also be added to the solution.

In addition, the solution may further contain a buffer, a brightening agent, a chelating agent, a defoaming agent and a fungicide, if desired.

After desilvering by fixation or bleach-fixation, the photographic material is generally rinsed in water and/or stabilized.

The amount of the water to be used in the rinsing step varies, depending upon the characteristics of the photographic material being processed (for example, the constituent elements such as couplers and others), the use of the material, the temperature of the rinsing water, the number of the rinsing baths (the number of rinsing stages), the replenishment system of normal current or countercurrent, and other various conditions, and therefore it may be defined in a broad range. For instance, the relation between the number of the rinsing tanks and the amount of the rinsing water in a multi-stage countercurrent rinsing system may be obtained by the method described in *Journal of the Society of Motion Picture and Television Engineering,* Vol. 64, pages 248 to 253 (May, 1955). In general, the number of the stages in a multi-stage countercurrent rinsing system is preferably from 2 to 6, especially preferably from 2 to 4.

In accordance with the multi-stage countercurrent rinsing system, the amount of the rinsing water to be used may noticeably be reduced, and for example, the amount may be from 0.5 liter to one liter per $m^2$ of the photographic material being processed. Accordingly, the effect of the present invention is remarkable when the rinsing is carried out by such a system. However, the system has the problem that bacteria would propagate in the rinsing tanks because of the increased residence time of the rinsing water in the tanks, so that the floating substances formed would adhere to the photographic material being processed. As a means of overcoming this problem, the method of reducing calcium and magnesium in the water, described in JP-a-62-288838, can be employed extremely effectively. In addition, isothiazolone compounds or thiabendazoles described in JP-A-57-8542; chlorine-containing microbicides such as sodium chloroisocyanurates described in JP-A-61-120145; benzotriazoles described in JP-A-61-267761; copper ions; as well as other microbicides described in H. Horiguchi, *Antibacteria and Antifungal Chemistry* (published by Sankyo Publishing Co., Japan, 1986), *Bactericidal and Fungicidal Technology of Microorganisms* (edited by Association of Sanitary Technology and published by Association of Industrial Technology, Japan, 1982) and *Encyclopeadia of Bactericidal and Fungicidal Agents* (edited by the Japanese Bactericide and Fungicide Association, Japan, 1986), can also be used for overcoming the problem.

In addition, the rinsing water may further contain a surfactant as a water-cutting agent, as well as a chelating agent such as EDTA as a water-softener.

Following the above-mentioned rinsing step or without the step, the material may be stabilized. The stabilizing solution to be used in the stabilizing step may contain a compound having the function of stabilizing the image formed. For instance, such compounds include an aldehyde compound such as formalin, a buffer for adjusting the film pH value to that suitable for stabilizing the dye formed, and an ammonium compound. In addition, the above-mentioned various fungicides and bactericides may be added to the stabilizing solution for the purpose of preventing propagation of bacteria or fungi in the solution or for the purpose of imparting the fungicidal property to the material processed.

Further, the solution may also contain a surfactant, a brightening agent and a hardening agent. In the processing method of the present invention, where the photographic material being processed is directly stabilized without the water-rinsing step, all the known techniques, for example, described in JP-A-57-8543, 58-14834 and 60-220345 can be employed.

One can mention as a further preferred embodiment for the stabilization step, employment of chelating agents such as 1 -hydroxyethylidene-1,1-diphosphonic acid or ethylenediaminetetramethylenephosphonic acid as well as magnesium or bismuth compounds.

A so-called rinsing solution may be employed as the water-rinsing solution or stabilizing solution in the step carried out after the desilvering step.

The pH value in the water-rinsing step or stabilizing step is preferably from 4 to 10, more preferably from 5 to 8. The temperature in the step may be determined in accordance with the use and characteristics of the photographic material being processed. In general, it may be 15° C. to 45° C., preferably 20° C. to 40° C. The processing time in the step may be determined freely but it is preferably short, since the total processing time is desired to be reduced. Preferably, the time for the water-rinsing or stabilizing step is from 15 seconds to one minute and 45 seconds, more preferably from 30 seconds to one minute and 30 seconds. The amount of the replenisher to the step is preferably small, for the purpose of the reducing running cost, reducing the amount of drainage and for easy handling.

Concretely, the amount of the replenisher to the step is from 0.5 to 50 times, preferably from 3 to 40 times, of the carry-over from the previous bath, per the unit area of the photographic material being processed. The amount may also be one liter or less, preferably 500 ml or less, per $m^2$ of the photographic material. The replenishment may be effected continuously or intermittently.

The solution used in the water-rinsing and/or stabilizing steps may be re-circulated to the previous bath. As one example of the system, the overflow from the rinsing water, which is reduced in the multistage countercurrent procedure, is re-circulated to the previous fixing bath or bleach-fixing bath whereupon a concentrated fresh bleach-fixing solution is replenished to the fixing bath or bleach-fixing bath. Accordingly, the amount of the waste to be drained by the system may be reduced.

Next, the processing machine (automatic developing machine) to be used in carrying out the method of the present invention will be explained in detail.

The processing machine to be used for processing silver halide photographic materials conveys the material being processed by various methods. Typical examples include conveyance with a pair of facing rollers (for a sheet developing machine), conveyance with leader belts and conveyance with clips. The processing method of the present invention applies to processing machines of any and every type. In particular, the method is especially effective when it is carried out by the use of a processing machine employing a conveyance system with leader belts, where the amount of the carry-over during the process frequently fluctuates as mentioned above. The conveyance system with leader belts includes two typical examples; and one is a processing machine for motion picture film where the photographic material to be processed is directly fixed to the leader belt and conveyed therewith in the machine, and the other is a processing machine where clips are attached to the leader belt and the photographic material to be processed is fixed to the belt via the clips and is conveyed in the machine. Comparing the two examples with each other, only one line can be processed by the use of one leader belt in the former system, while two or more lines can be processed by attaching plural clips to the both right and left sides of the leader belt. Preferably, the processing method of the present invention may apply to the processing machines of the both types.

Next, specific examples of processing machines usable for carrying out the method of the present invention are mentioned below, which, however, are not intended to be limiting.

Fuji Color Negative Film Processor FNCP600, FNCP900 (manufactured by Fuji Photo Film Co.)

Fuji Color Paper Processor FPRP406, FPRO409, FPRP412 (manufactured by Fuji Photo Film Co.)

It is preferred that the processing machine to be used for carrying out the method of the present invention is equipped with a sensor which acts and senses when the liquid level of the working solution in the processing tank (tank liquid level) becomes lower than a predetermined level. Specifically, the machine is preferably equipped with a liquid level sensor such as a float switch. In this case, it is preferred that the position of the liquid level sensor is set in such a way that the sensor acts to sense the lowering of the liquid level of from 1% to 20%, more preferably from 2% to 20%, in particular, preferably from 2% to 10%, most preferably from 4% to 10% of the tank capacity. If the position of the sensor is too high (or that is, the liquid level which is sensed by the sensor is smaller than the above-mentioned range), error would often occur. However, if it is too low, photographic characteristics of the material processed would fluctuate or the heater and other circulation means of the machine would be adversely influenced by the lowering of the liquid level of the processing tank. The tank capacity as referred to herein means the capacity of the tank below the overflow holes, if any. If the tank does not have overflow holes, the tank capacity means the standard liquid capacity of the tank. The amount replenished may be somewhat in excess of the amount the liquid level has lowered if the tank has overflow holes.

In accordance with the method of the present invention, a fresh tank solution or overflow solution is automatically supplemented to the processing tank, depending upon the action of the above-mentioned sensor. The amount of the solution to be supplemented to the tank is preferably such that could compensate or correct the lowered liquid level to a predetermined level. Additionally, it is also preferred to separately arrange a stock tank for the solution.

A mixture of the fresh tank solution and the overflow solution can be used in the present invention.

In preparing the fresh tank solution, the necessary components may be dissolved in a different tank and the thus prepared fresh solution may be introduced into the stock tank; or various concentrated components are automatically diluted with water and introduced into the stock tank. Alternatively, in preparing the fresh tank solution, the freshly prepared solution may be directly fed to the processing tank.

The preferred-embodiment of the method of the present invention is that an overflow solution, if any, is first stored in a stock tank, a fresh tank solution is added to the stored overflow solution, and the resulting blend solution is used for compensating and correcting the liquid level of the processing tank. The embodiment is recommended, since the amount of the fresh tank solution to be used may be economized, the amount of the waste liquid to be drained from the processing system may be reduced, the processing cost may be reduced and additionally the process is favorable for prevention of environmental pollution.

The stock tank is preferably equipped with a floating lid or floating balls for the purpose of anti-oxidation. The size of the stock tank may be approximately from 0.01 to 0.5 times, preferably approximately from 0.05 to 0.2 times the tank capacity of the processing machine.

In another embodiment, the amount of fresh tank solution or overflow solution is supplied to the processing tank is from 0 to 0.3 times, preferably from 0.001 to 0.2 times the amount of the replenishing solution replenished. In case where the overflow solution in the stock tank is insufficient, one can always carry out the process by replenishing an amount of the replenishing solution which is greater than the standard amount, and when the level of the processing tank decreases one can preferably supply the overflow solution to the processing tank or separately make up fresh tank solution and fill up the stock tank. If overflow always occurs, in order to reduce the amount of waste liquid, one can carry out the process by reducing the amount of replenishing liquid replenished, and, when the level of the working solution falls, the processing tank is replenished by the overflow solution in the stock tank.

The process of the present invention is particularly preferred when the amount of solution replenished to the process solution is equal to or greater than the carry over solution (the solution carried over to a subsequent process step along with the photographic material and the leader belt or other conveying means). The process is particularly preferred when the amount of solution replenished is greater than the carry out solution.

Next, photographic materials to be processed by the method of the present invention will be explained hereunder.

Any and every silver halide photographic material may be processed by the method of the present invention. Most preferably, a silver halide color photographic material containing a high-silver chloride emulsion is processed by the method, because the amount of the replenisher to the method may noticeably be reduced.

Preferred color photographic photosensitive material of the present invention can be prepared by forming at least one blue-sensitive silver halide emulsion layer, at least one green-sensitive silver halide emulsion layer and at least one red-sensitive silver halide emulsion layer on a support. Although the layers are formed in this order on the support in an ordinary color photographic paper, the order is not particularly limited. One or more of these emulsion layers can be replaced with an infrared ray-sensitive silver halide emulsion layer. The color reproduction by subtractive color photography can be conducted by using a photosensitive emulsion layer comprising a silver halide emulsion having a sensitivity in a specified wave length region and a so-called color coupler forming a dye complementary to the light of sensitization, i.e. yellow for blue, magenta for green or cyan for red. However, the combination of the photosensitive layer with the developed dye not having the relationship as described above can also be employed.

Although the halogen composition of the silver halide emulsion used in the present invention is not particularly limited, it is particularly preferred for attaining the object of the present invention that it is a silver chlorobromide composition comprising at least 80 molar % of silver chloride and substantially free from silver iodide. The term "substantially free from silver iodide" herein indicates that silver iodide content is not higher than 1.0 molar %, preferably not higher than 0.2 molar %. When the silver chloride content is lower than this range or the silver iodide content is higher than it, the development velocity is low and the intended rapid process is impossible. Thus, the higher the silver chloride content, the better. Namely, it is preferably at least 90 molar %, particularly at least 95 molar %. It is also preferred to further increase the silver chloride content of the silver halide emulsion in order to reduce the quantity of replenisher for developing solution. In such a case, an emulsion of substantially pure silver chloride having a silver chloride content of 98 to 99.9 molar % is also preferred. However, a completely pure silver chloride emulsion is often disadvantageous for obtaining a high sensitivity or for inhibiting fogging caused when a pressure is applied to the photosensitive material.

The halogen composition of the emulsion may be the same or different among the grains. When an emulsion containing grains having the same halogen composition is used, the properties of the grains can be easily made the same. As for the halogen composition distribution in the silver halide grains in the emulsion, it can be suitably selected from among (1) grains of so-called homogeneous structure wherein the composition of any parts of the silver halide grains is the same, (2) grains of so-called laminate structure wherein the halogen composition in the core is different from that of the shell (comprising one or more layers) in the silver halide grains and (3) grains having such a structure that the grains have non-layer parts having different halogen compositions in the core or on the surface thereof (when these parts are on the grain surface, the structure is such that parts having a different composition are bonded to the edges, corners or surface of the grain). For obtaining a high sensitivity, the latter grains (2) and (3) are preferred to the grains (1) having the homogeneous structure. The latter grains (2) and (3) are preferred also from the viewpoint of pressure resistance. When the silver halide grains have either of the latter two structures, the boundary between the two different halogen compositions may be (1) a clear one, (2) an unclear one formed by mixed crystals formed by the compositions different from one another or (3) such a boundary that the structure of which is positively and continuously changed.

In the emulsion of the high-silver chloride content, the grains desirably have such a structure that the above-described layer or parts locally containing silver bromide is (are) formed in the silver halide grains and/or on the surface thereof. The halogen composition in the layer or parts locally containing silver bromide has a silver bromide content of desirably at least 10 molar %, more desirably at least 20 molar %. Such a layer or parts can be formed in the grains, on the surface of the grains or at edges or corners of them. In a preferred embodiment of them, the parts epitaxially grow at some corners of the grains.

The grains having the homogeneous type structure, i.e. a low halogen composition distribution, are also preferred in the emulsion having a silver chloride content of as high as 90 molar % or above, since the effect of the present invention can be more improved with them.

The amount (in terms of silver) of the silver halide emulsion for the coating in the present invention is preferably 0.80 g or less per square meter of the photosensitive material from the viewpoints of reducing the quantity of the replenisher, inhibiting the fogging and decreasing the photographic variation and stain.

The amount is preferably 0.75 g or below, still preferably 0.70 g or below (in the first embodiment) or still preferably 0.65 g or below (in the second embodiment), per square meter of the photosensitive material.

The average size of the silver halide grains contained in the silver halide emulsion used in the present invention (the number-average of the grain size which is given in terms of the diameter of a circle having an area equal to the projection area of the grain) is preferably 0.1 to 2 μm.

As for the grain size distribution, the emulsion is preferably a so-called monodisperse emulsion having a coefficient of variation (obtained by dividing the standard deviation of the grain size distribution by the average grain size) of 20% or below, desirably 15% or below. In order to obtain a wide latitude, the monodisperse emulsion is preferably blended in the layer or it is applied thereto to form another layer.

The shape of the silver halide grains contained in the photographic emulsion may be a regular crystalline form such as cubic, tetradecahedral or octahedral form; an irregular crystalline form such as spherical or tabular form; or a mixture of them. The grains may be a mixture of those having various crystal forms. It is desirable in the present invention that at least 50%, preferably at least 70% and particularly at least 90%, of the silver halide grains have the regular crystal form.

An emulsion wherein more than 50% of the projection area of the total grains comprise tabular grains having an average aspect ratio (ratio of the diameter of the circles having an area equal to the projection area of the grains/thickness) of at least 5, preferably at least 8, is also preferably used.

Various polyvalent metal ion dopants can be incorporated into the silver halide emulsion used in the present invention in the course of the formation of the grains in the emulsion or during the physical aging. Examples of the compounds used are salts of cadmium, zinc, lead, copper and thallium as well as salts and complex salts of elements of the Group VIII such as iron, ruthenium, rhodium, palladium, osmium, iridium and platinum. Among them, the elements of the Group VIII are particularly preferred. The amount of these compounds which varies over a wide range depending on the purpose is preferably $10^{-9}$ to $10^{-2}$ mol per mol of the silver halide.

The silver halide emulsion used in the present invention is usually chemically or spectrally sensitized.

The chemical sensitization can be conducted by sulfur sensitization typified by a sensitization method with an unstable sulfur compound, noble metal sensitization typified by a sensitization method with gold, or reduction sensitization. These methods may be combined together, if necessary. The compounds used for the chemical sensitization are preferably those described from the right, lower column, page 18 to the right, upper column, page 22, of Japanese Patent Unexamined Published Application (hereinafter referred to as "J. P. KOKAI") No. Sho 62-21527.

The spectral sensitization is conducted in order to impart the spectral sensitivity in a desired light wave length region to the emulsion constituting each layer in the photosensitive material of the present invention. It is preferred in the present invention to incorporate a dye (spectral sensitizing dye) which absorbs the light in the wave length region corresponding to the intended spectral sensitivity. Examples of the spectral sensitizing dyes used for this purpose include those described in F. M. Harmer "Heterocyclic compounds—Cyanine dyes and related compounds" [published by John Wiley & Sons (New York and London) in 1964]. Examples of the preferred compounds and the spectral sensitization method are described in the above-described J. P. KOKAI No. 62-215272 (from the right, upper column, p. 22 to p. 38).

The silver halide emulsion used in the present invention can contain various compounds or precursors thereof in order to inhibit the fogging during the preparation or storage of the photosensitive material, during the storage or during the photographic process or to stabilize the photographic properties. Examples of the preferred compounds are described on pages 39 to 72 of the above-described J. P. KOKAI No. 62-215272.

The emulsion used in the present invention may be either a so-called surface latent image-type emulsion wherein the latent image is formed mainly on the grain surface or a so-called core latent image-type emulsion wherein the latent image is formed mainly in the grain.

When the present invention is employed in a color photosensitive material, this material usually contains a yellow coupler, magenta coupler and cyan coupler which couple with an oxidized aromatic amine color developer to develop yellow, magenta and cyan colors, respectively.

The cyan couplers, magenta couplers and yellow couplers preferably used in the present invention are those represented by the following general formulae (C-1), (C-II), (M-I), (M-II) and (Y):

General formula (C-I):

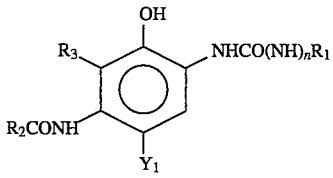

General formula (C-II):

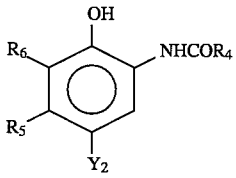

General formula (M-I):

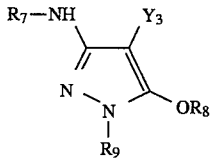

General formula (M-II):

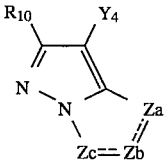

-continued

General formula (Y):

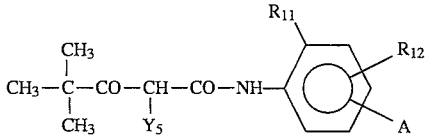

In the general formulae (C-I) and (C-II), $R_1$, $R_2$ and $R_4$ each represent a substituted or unsubstituted aliphatic, aromatic or heterocyclic group, $R_3$, $R_5$ and $R_6$ each represent a hydrogen atom, halogen atom, alihatic group, aromatic group or acylamino group or $R_3$ may be non-metallic atoms which form a nitrogen-containing, five-membered or six-membered ring together with $R_2$, $Y_1$ and $Y_2$ each represent a hydrogen atom or a group which is split off by the coupling reaction with the oxidated developing agent and n represents 0 or 1.

$R_5$ in the general formula (C-II) is preferably an aliphatic group such as methyl, ethyl, propyl, butyl, pentadecyl, tert-butyl, cyclohexyl, cyclohexylmethyl, phenylthiomethyl, dodecyloxyphenylthiomethyl, butanamidemethyl or methoxymethyl group.

Preferred examples of the cyan couplers of the above general formulae (C-I) and (C-II) will be described below.

Preferred $R_1$ in the general formula (C-I) is an aryl or heterocyclic group and still preferred $R_1$ is an aryl group substituted with a halogen atom or an alkyl, alkoxy, aryloxy, acylamino, acyl, carbamoyl, sulfonamide, sulfamoyl, sulfonyl, sulfamide, oxycarbonyl or cyano group.

When $R_3$ and $R_2$ in the general formula (C-I) do not form together a ring, $R_2$ is preferably a substituted or unsubstituted alkyl or aryl group, particularly preferably an alkyl group substituted with a substituted aryloxy group and $R_3$ is preferably a hydrogen atom.

$R_4$ in the general formula (C-II) is preferably a substituted or unsubstituted alkyl or aryl group, particularly preferably an alkyl group substituted with a substituted aryloxy group.

Preferred $R_5$ in the general formula (C-II) is an alkyl group having 2 to 15 carbon atoms or methyl group having a substituent having at least 1 carbon atom. The substituents are preferably arylthio, alkylthio, acylamino, aryloxy and alkyloxy groups.

$R_5$ in the general formula (C-II) is still preferably an alkyl group having 2 to 15 carbon atoms, particularly an alkyl group having 2 to 4 carbon atoms.

Preferred $R_6$ in the general formula (C-II) is a hydrogen atom or halogen atom/particularly chlorine or fluorine atom. Preferred $Y_1$ and $Y_2$ in the general formulae (C-I) and (C-II) are each a hydrogen or halogen atom, or an alkoxy, aryloxy, acyloxy or sulfonamide group.

In the general formula (M-I), $R_7$ and $R_9$ each represent an aryl group, $R_8$ represents a hydrogen atom or an aliphatic or aromatic acyl group or an aliphatic or aromatic sulfonyl group, $Y_3$ represents a hydrogen atom or a group which can be split off, the allowable substituents for the aryl group (preferably phenyl group) of $R_7$ and $R_9$ are the same as those for $R_1$ and when them are two or more substituents, they may be either the same or different from one another. $R_8$ is preferably a hydrogen atom or an aliphatic acyl or sulfonyl group. It is particularly preferably a hydrogen atom. Preferred $Y_3$ is of sulfur-, oxygen- or nitrogen-linked coupling-off type. For example, that of sulfur-linked coupling-off type described in U.S. Pat. No. 4,351,897 and International Publication WO 088/04795 is particularly preferred.

In the general formula (M-II), $R_{10}$ represents a hydrogen atom or a substituent, $Y_4$ represents a hydrogen atom or a group which can be split off, particularly preferably a halogen atom or an arylthio group, Za, Zb and Zc each represent methine, substituted methine, =N— or —NH—, one of the Za-Zb bond and Zb-Zc bond is a double bond and the other is a single bond, when the Zb-Zc bond is a carbon-to-carbon double bond, it may be a part of the aromatic ring, and when $R_{10}$ or $Y_4$ forms a dimer or polymer or when Za, Zb or Zc is a substituted methine, the substituted methine may form a dimer or polymer.

Among the pyrazoloazole couplers of the general formula (M-II), imidazo[1,2-b]pyrazoles described in U.S. Pat. No. 4,500,630 are preferred and pyrazolo[1,5-b][1,2,4]triazole described in U.S. Pat. No. 4,540,654 is particularly preferred from the viewpoint of the yellow sub-absorption of the developed dye and fastness to light.

Preferred are also pyrazolotriazole couplers having a branched alkyl group directly bonded to 2-, 3- or 6-position of the pyrazolotriazole ring as described in J. P. KOKAI No. 61-65245, pyrazoloazole couplers having a sulfonamide group in the molecule as described in J. P. KOKAI No. Sho 61-65246, pyrazoloazole couplers having an alkoxyphenylsulfonamide ballast group as described in J. P. KOKAI No. 61-147254 and pyrazolotriazole couplers having an alkoxy group or aryloxy group at 6-position as described in European Patent (Publication) Nos. 226,849 and 294,785.

In the general formula (Y), $R_{11}$ represents a halogen atom, alkoxy, trifluoromethyl or aryl group, $R_{12}$ represents a hydrogen or halogen atom or alkoxy group, A represents $—NHCOR_{13}$, $—NHSO_2—R_{13}$, $—SO_2NHR_{13}$, $—COOR_{13}$ or $—SO_2N(R_{14})—R_{13}$ ($R_{13}$ and $R_{14}$ being each an alkyl, aryl or acyl group), and $Y_5$ represents a group which can be split off. The substituents of $R_{12}$, $R_{13}$ and $R_{14}$ are the same as those allowed for $R_1$. $Y_5$ is preferably of either oxygen-linked or nitrogen-linked coupling off type, the latter being particularly preferred.

The coupler represented by any of the above general formulae (C-I) to (Y) is contained in the silver halide emulsion layer constituting the photosensitive layer usually in an amount of 0.1 to 1.0 mol, preferably 0.1 to 0.5 mol, per mol of the silver halide.

The coupler can be incorporated into the photosensitive layer by various well known methods in the present invention. Usually the coupler is incorporated thereinto by an oil-in-water dispersion method known as oil protecting method wherein the coupler is dissolved in a solvent and the solution is emulsion-dispersed in an aqueous gelatin solution containing a surfactant. Alternatively water or an aqueous gelatin solution is added to a coupler solution containing a surfactant to obtain an oil-in water dispersion by phase inversion. An alkali-soluble coupler can be dispersed also by so-called Fischer's dispersion method. The low-boiling organic solvent can be removed from the coupler dispersion by distillation, noodle washing or ultrafiltration and the residue is mixed with a photographic emulsion.

As the dispersion medium for the coupler, a hig-boiling organic solvent and/or water-insoluble high-molecular compound having a dielectric constant (25° C.) of 2 to 20 and a refractive index (25° C.) of 1.5 to 1.7 is preferably used.

The high-boiling organic solvents are preferably those of the following general formulae (A) through (E). In this connection, couplers-represented by the above general formulae (C-I), (C-II), (M-I), (M-II) and (Y) are particularly preferred.

General formula (A):

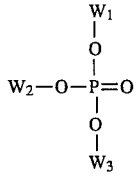

General formula (B):

$W_1-COO-W_2$

General formula (C):

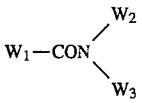

General formula (D):

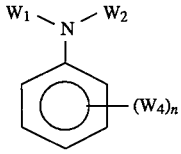

General formula (E):

$W_1-O-W_2$ wherein $W_1$, $W_2$ and $W_3$ each represent a substituted or unsubstituted alkyl, cycloalkyl, alkenyl, aryl or heterocyclic group, $W_4$ represents $W_1$, $OW_1$ or S-$W_1$, n represents an integer of 1 to 5, when n is 2 or larger, $W_4$'s may be the same or different from one another, and $W_1$ and $W_2$ in the general formula (E) may form together a condensed ring.

In addition to the high-boiling organic solvents of the general formulae (A) to (E), those having a melting point of 100 ° C. or below and a boiling point of at least 140° C., immiscible with water and usable as a good solvent for the coupler can also be used in the present invention. The melting point of the high-boiling organic solvent is preferably not higher than 80° C. . The boiling point of the high-boiling organic solvent is preferably at least 160° C., still preferably at least 170° C.

The details of the high-boiling organic solvents are described in J. P. KOKAI No. Sho 62-215272 (from the right, lower column, p. 137 to the right, upper column, p. 144).

These couplers can be emulsion-dispersed as follows: a loadable latex polymer (described in, for example, U.S. Pat. No. 4,203,716) is impregnated with the coupler in the presence or absence of the above-described high-boiling organic solvent or, alternatively, the coupler is dissolved in a water-insoluble, organic solvent-soluble polymer and then it is emulsion-dispersed in an aqueous solution of a hydrophilic colloid.

A homopolymer or copolymer described on pages 12 to 30 of International Publication No. WO 88/00723 is preferably used. An acrylamide polymer is particularly preferred for stabilization of the color image.

The photosensitive material produced according to the present invention may contain a hydroquinone derivative, aminophenol derivative, gallic acid derivative, ascorbic acid derivative or the like as a color antifoggant.

The photosensitive material usable in the present invention may contain various decoloration inhibitors. Organic decoloration inhibitors for the cyan, magenta and/or yellow images include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines and ether or ester derivatives of them obtained by silylating or alkylating the phenolic hydroxyl group of these compounds. Further metal complexes such as (bissalicylaldoxymato) nickel complexes and (bis-N,N-dialkyldithiocarbamato) nickel complexes are also usable.

Examples of the organic decoloration inhibitors are described in the patent specifications as will be described below.

Hydroquinones are described in, for example, U.S. Pat. Nos. 2,360,290, 2,418,613, 2,700,453, 2,701,197, 2,728,659, 2,732,300, 2,735,765, 3,982,944 and 4,430,425, British Patent No. 1,363,921 and U.S. Pat. Nos. 2,710,801 and 2,816,028. 6-Hydroxychromans, 5-hydroxycoumarans and spirochromans are described in U.S. Pat. Nos. 3,432,300, 3,573,050, 3,574,627, 3,698,909 and 3,764,337 and J. P. KOKAI No. Sho 52-152225. Spiroindanes are described in U.S. Pat. No. 4,360,589. p-Alkoxyphenols are described in U.S. Pat. No. 2,735,765, British Patent No. 2,066,975, J. P. KOKAI No. Sho 59-10539 and Japanese Patent Publication for Opposition Purpose (hereinafter referred to as "J. P. KOKOKU") No. Sho 57-19765. The hindered phenols are described in U.S. Pat. No. 3,700,455, J. P. KOKAI No. 52-72224, U.S. Pat. No. 4,228,235 and J. P. KOKOKU No. Sho 52-6623. The gallic acid derivatives, m ethylenedioxybenzenes and aminophenols are described in U.S. Pat. Nos. 3,457,079 and 4,332,886 and J. P. KOKOKU No. Sho 56-21144, respectively. The hindered amines are described in U.S. Pat. Nos. 3,336,135 and 4,268,593, British Patent Nos. 1,326,889, 1,354,313 and 1,410,846, J. P. KOKOKU No. Sho 51-1420 and J. P. KOKAI Nos.. Sho 58-114036, Sho 59-53846 and Sho 59- 78344. The metal complexes are described in U.S. Pat. Nos. 4,050,938 and 4,241,155 and British Patent No. 2,027,731 (A). The purpose can be attained by co-emulsifying usually 5 to 100 % by weight, based on the corresponding coupler, of the compound with the coupler and incorporating the resultant product into the photosensitive layer. To prevent the cyan color image from deterioration by heat and particularly by light, it is effective to introduce an ultraviolet ray-absorber into the cyan coupling layer and both layers adjacent to the cyan coupling layer.

The ultraviolet ray absorbers usable herein include benzotriazole compounds substituted with an aryl group (such as those described in U.S. Pat. No. 3,533,794), 4-thiazolidone compounds (such as those described in U.S. Pat. Nos. 3,314,794 and 3,352,681), benzophenone compounds (such as those described in J. P. KOKAI No. Sho 46-2784), cinnamic ester compounds (such as those described in U.S. Pat. Nos. 3,705,805 and 3,707,395), butadiene compounds (those described in U.S. Pat. No. 4,045,229) and benzoxidol compounds (such as those described in U.S. Pat. Nos. 3,406,070, 3,677,672 and 4,271,307). Ultraviolet ray-absorbing couplers (such as cyan dye-forming α-naphthol couplers) and ultraviolet ray-absorbing polymers can also be used. These ultraviolet ray absorbents may be mordanted in a specified layer.

Among them, the benzotriazole compounds substituted with the above-described aryl group are preferred.

These couplers are preferably used in combination with compounds which will be described below, particularly pyrazoloazole coupler.

Namely, to prevent stains caused by a developed dye formed by the reaction of the color developing agent remaining in the layer or an oxidation product thereof with the coupler or by other side reactions during the storage after completion of the process, it is preferred to use a compound (F) capable of forming a chemically inert, substantially colorless compound by chemically bonding with the aromatic amine developing agent remaining after the color developing process and/or a compound (G) capable of forming a chemically inert, substantially colorless compound by chemically bonding with an oxidation product of the aromatic amine color developing agent remaining after the color developing process.

Preferred compounds (F) are those having a rate constant of the second-order reaction $k_2$ with p-anisidine (in trioctyl phosphate at 80° C.) of 1.0 to $1\times10^{-5}$ l/mol. sec. The rate constant of the second-order reaction can be determined by a method described in J. P. KOKAI No. Sho 63-158545.

When $k_2$ is beyond this range, the compound per se is unstable and is often decomposed by reaction with gelatin or water. On the contrary, when $k_2$ is below this range, the reaction with the remaining aromatic amine developing agent proceeds only slowly and, therefore, side reactions of the remaining aromatic amine developing agent cannot be inhibited.

Still preferred examples of the compounds (F) are those of the following general formula (FI) or (FII):

General formula (FI):

$$R_1-(A)_n-X$$

General formula (FII):

$$R_2-\underset{\underset{B}{|}}{C}=Y$$

wherein $R_1$ and $R_2$ each represent an aliphatic, aromatic or heterocyclic group, n represents 0 or 1, A represents a group capable of reacting with the aromatic amine developing agent to form a chemical bond, X represents a group capable of being split off upon reaction with the aromatic amine developing agent, B represents a hydrogen atom or an aliphatic, aromatic, heterocyclic, acyl or sulfonyl group and Y represents a group capable of accelerating the addition of the aromatic amine developing agent to the compound of the general formula (FII), or $R_1$ and X, or Y and $R_2$ or B may be bonded together to form a cyclic structure.

Typical methods for the chemical bonding with the remaining aromatic amine developing agent are substitution reaction and addition reaction.

Preferred compounds of the general formula (FI) or (FII) are those described in J. P. KOKAI Nos. Sho 63-158545 and Sho 62-283338 and European Patent KOKAI Nos. 298321 and 277589.

Still preferred examples of the compounds (G) capable of forming a chemically inert, colorless compound by chemically bonding with an oxidation product of the aromatic amine color developing agent remaining after the color developing process are those of the following general formula (GI):

General formula (GI):

$$R-Z$$

wherein R represents an aliphatic, aromatic or heterocyclic group and Z represents a nucleophilic group or a group which is decomposed in the photosensitive material to release the nucleophilic group. Z in the compound of the general formula (GI) has a Pearson's nucleophilic "$CH_3I$ value [R. G. Pearson, et al., J. Am. Chem. Soc., 90, 319 (1968)] of at least 5 or a group derived therefrom.

Preferred examples of the compounds of the general formula (GI) are those described in European Patent Publication No. 255722, J. P. KOKAI Nos. Sho 62-143048 and Sho 62-229145, Japanese Patent Application Nos. Sho 63-136724 and 62-214681 and European Patent Publication Nos. 298321 and 277589.

The details of the combination of the compound (G) with the compound (F) are described in European Patent Publication No. 277589.

The photosensitive material produced according to the present invention may contain, in the hydrophilic colloid layer, a hydrophilic dye or a dye which is solubilized in water by the photographic process as a filter dye or in order to prevent irradiation or halation. These dyes include oxonol dyes, hemioxonol dyes, styryl dyes, merocyanine dyes, cyanine dyes and azo dyes. Among them, the oxonol dyes, hemioxonol dyes and merocyanine dyes are particularly useful.

Gelatin is advantageously used as the binder or protective colloid usable in the emulsion layer of the photosensitive material of the present invention. Other hydrophilic colloids can also be used singly or in combination with gelatin.

The gelatin used in the present invention may be treated with either lime or an acid. The processes for producing gelatin are described in detail in Arther Weiss, The Macromolecular Chemistry of Gelatin (published by Academic Press in 1964).

The supports usable in the present invention include transparent films such as cellulose nitrate films and polyethylene terephthalate films and reflection-type supports usually used as a material for the photosensitive materials. Printing materials containing the reflective support are still preferred for the purpose of the present invention.

The term "reflective supports" herein indicates those capable of improving the reflectivity to make the dye image formed on the silver halide emulsion layer clear. These reflective supports include those comprising a support coated with a hydrophobic resin containing a light-reflecting substance such as titanium oxide, zinc oxide, calcium carbonate or calcium sulfate dispersed therein and those comprising a support containing such a light-reflecting substance dispersed therein. The reflective supports include, for example, a baryta paper, polypethylene-coated paper, synthetic polypropylene paper, and transparent support on which a reflecting layer is to be formed or which is to be used in combination with a reflecting substance such as glass plate, polyester film (e.g. polyethylene terephthalate, cellulose triacetate or cellulose nitrate), polyamide film, polycarbonate film, polystyrene film or vinyl chloride resin film.

The other reflective supports such as those having a mirror plane-reflective or second diffuse reflective metal surface can be used. The spectral reflectance of the metal surface in the visible wave length region is preferably at least 0.5. The metal surface is desirably toughened or made diffuse reflective with a metal powder. The metals usable for this purpose include aluminum, tin, silver, magnesium and alloys of them. The surface may be that of a metal sheet, metal foil or thin metal layer formed by rolling, vapor deposition or plating.

It is particularly desirable to form the metal surface by the vapor deposition on the support made of another material. Preferably a water-resistant resin layer, particularly a thermoplastic resin layer, is formed on the metal surface. An antistatic layer is preferably formed on the other side (metal surface-free side) of the support of the present invention. The details of the supports are described in, for example, J. P. KOKAI Nos. Sho 61-210346, Sho 63-24247, Sho 63-24251 and Sho 63- 24255.

The support can be suitably selected depending on the use.

As the light-reflecting substance, a white pigment is preferred. It is thoroughly kneaded in the presence of a surfactant. The surface of the pigment particles is preferably treated with a dihydric to tetrahydric alcohol.

The ratio (%) of the occupation area of the fine particles of the white pigment to a specified unit area can be determined by, most typically, dividing the observed area into unit areas (6 μm×6 μm) adjacent to each other and determining the projected area ratio of the fine particles in the unit area (%) ($R_i$). The coefficient of variation of the ratio (%) of the occupation area is determined by the ratio of the standard deviation (s) of $R_i$ to the average of $R_i$ (R), i.e. s/R. The number (n) of the unit areas is preferably at least 6. Thus the coefficient of variation s/R can be determined by the following formula:

$$\sqrt{\frac{\sum_{i=1}^{n}(R_i-\bar{R})^2}{n-1}} \Big/ \frac{\sum_{i=1}^{n}R_i}{n}$$

The coefficient of variation of the ratio (%) of the occupation area of the fine pigment particles is preferably not higher than 0.15, particularly not higher than 0.12 in the present invention. When it is below 0.08, the dispersion of the particles is substantially "homogeneous".

EXAMPLE 1: Fresh Tank Solution

A film of Fuji Color Paper Super FA Type II (product by Fuji Photo Film Co.) was imagewise exposed and then continuously processed in accordance with the processing method mentioned below.

(1) Processing Machine:

Fuji Color Paper Processor FPRP409 (manufactured by Fuji Photo Film Co.) was used, after the processing section thereof was partly modified.

Linear Velocity: 9 m/min

Leader Belt Conveyance System:

Using two leader belts, at most four lines of photographic papers can be processed at the same time.

Percentage of use of the leader belts in the processing was as follows:

| | |
|---|---|
| 1 line | 20% |
| 2 lines | 30% |
| 3 lines | 40% |
| 4 lines | 10% |

(2) Processing Steps:

| Step | Temperature (°C.) | Time (sec) | Amount of Replenisher (ml/m²) | Tank Capacity (liter) |
|---|---|---|---|---|
| Color Development | 39 | 45 | 60 | 500 |
| Bleach-fixing | 30 to 35 | 45 | 55 | 500 |
| Rinsing (1) | 30 to 35 | 20 | — | 200 |
| Rinsing (2) | 30 to 35 | 20 | — | 200 |
| Rinsing (3) | 30 to 35 | 20 | — | 200 |
| Rinsing (4) | 30 to 35 | 20 | — | 200 |
| Rinsing (5) | 30 to 35 | 20 | 300 | 200 |

(Rinsing was effected by countercurrent system from rinsing tank (5) to rinsing tank (1) in back order. Tank capacity of the stock tank for the fresh developing tank solution was 100 liter).

1700 m² of the above-mentioned photographic print material (8.9 cm width) was continuously processed over a period of 10 days, in accordance with each of the following three methods. In these method, an average carry-over amount was 57 ml/m². Precisely, each of the following tank solutions was filled in the processing tank before start of the continuous processing. After the process was started, the following replenisher was replenished when every 10 m² of the photographic materials were processed and the process was continued. In this connection, although the leader belts did not stop during the 10 day processing, the total time when the photographic materials were processed in the tank was 16 hours per day.

Test (1) (conventional method):

The replenisher was replenished only.

Test (2) (comparative method):

When the liquid level in the color developer tank become lower than 2 cm (corresponding to about 10 liters) below overflow holes which were positioned 10 cm from the upper level of the tank, water was added so as to maintain the standard liquid level (below the overflow holes).

Test (3) (method of the invention):

When the liquid level in the color developer tank became lower than 2 cm (corresponding to about 10 liters) below overflow holes which were positioned 10 cm from the upper level of the tank, a fresh tank solution was supplied to the tank so that the liquid level of the tank was corrected to the standard level (below the overflow holes).

The processing solutions used in the test processes are mentioned below.

| | Fresh Tank Solution | Replenisher |
|---|---|---|
| Color Developer: | | |
| Triethanolamine | 10 g | 10 g |
| 1-Hydroxyethylidene-1,1-diphosphonic Acid (60 wt. %) | 2 g | 2 g |
| Diethylenetriamine-pentaacetic Acid | 1 g | 1 g |
| Nitrilo-N,N,N-trimethylene-phosphonic Acid (40 wt. %) | 8 g | 8 g |
| Potassium Chloride | 6.5 g | — |
| Potassium Bromide | 0.02 g | — |
| Hydrazino-diacetic Acid | 5 g | 9 g |
| N-ethyl-N-(β-methane-sulfonamidoethyl)-3-methyl-4-aminoaniline Sulfate | 5 g | 13 g |
| Brightening Agent (WHITEX 4, product by Sumitomo Chemical) | 1.25 g | 3.5 g |
| Potassium Carbonate | 25 g | 25 g |
| Sodium Sulfite | 0.1 g | — |
| Water to make | 1000 ml | 1000 ml |
| KOH to make | pH of 10.00 | pH of 11.10 |
| Bleach-fixing Solution: | | |
| Ammonium Thiosulfate (70 w/v %) | 110 ml | 220 ml |
| Ammonium Sulfite Monohydrate | 19.4 g | 38.8 g |
| EDTA | 1.5 g | 3.0 g |
| EDTA/$FeNH_4$ | 55 g | 110 g |
| Ammonium Bromide | 25 g | 50 g |
| Nitric Acid (67%) | 24.5 g | 49 g |
| Water to make | 1000 ml | 1000 ml |
| pH | 5.20 | 4.80 |

Rinsing Solution:

Ion-exchanged water (having calcium content of 3 ppm or less and magnesium content of 3 ppm or less).

In accordance with the above-mentioned Tests (1) to (3), photographic films of Fuji Color Paper Control Strips Super PA TYPE II (product by Fuji Photo Film Co.) were processed every day in order to evaluate the time-dependent variation of the photographic characteristics of the processed films, whereupon variation of the photographic characteristics of the films from the start time was obtained with respect to the variation of the sensitivity LD and that of gradation C.

The variation of the magenta density of the color image formed is shown in Table 1 below, where "+5" means that the density increased by 0.05 and the minus value indicates decrease of the density value.

The results obtained are shown in Table 1 below.

TABLE 1

| | Test (1) | | Test (2) | | Test (3)* | |
|---|---|---|---|---|---|---|
| Test Date | LD | C | LD | C | LD | C |
| 1 | 0 | 0 | 0 | 0 | 0 | 0 |
| 2 | −3 | +2 | −2 | −2 | −1 | +1 |
| 3 | −5 | +4 | −4 | −3 | −1 | +1 |
| 4 | −7 | +6 | −6 | −5 | −1 | +2 |
| 5 | −10 | +7 | −7 | −7 | −2 | +2 |
| 6 | −12 | +8 | −8 | −8 | −2 | +2 |
| 7 | −14 | +9 | −9 | −9 | −2 | +2 |
| 8 | −16 | +10 | −10 | −10 | −2 | +3 |
| 9 | −17 | +11 | −11 | −10 | −3 | +3 |
| 10 | −18 | +11 | 11 | −10 | −3 | +3 |

Test (3)* is the example of the invention.

In Test (1), the liquid level gradually lowered and it lowered by about 50 liters after 5 days. As a result, air was engulfed into the circulation system so that the developer being used was oxidized. Additionally, the processing time was shortened and the processing solution was concentrated because of the lowering of the liquid level of the solution in the processing tank, whereby the sensitivity of the material processed lowered and the contrast thereof became hard.

In Test (2), the working solution was diluted because of addition of water thereto. As a result, the sensitivity of the material processed lowered and the contrast thereof became soft. That is, the photographic properties of the materials processed in Test (2) worsened with the lapse of the processing time.

In Test (3) of the method of the present invention, the photographic properties of the materials processed hardly fluctuated throughout the continuous process, and the test result was good.

EXAMPLE 2: Overflow Solution

A film of Fuji Color Paper Super FA Type II (product by Fuji Photo Film Co.) was imagewise exposed and then continuously processed in accordance with the processing method mentioned below.

(1) Processing Machine: Same as Example 1

(2) Processing Steps:

| Step | Temperature (°C.) | Time (sec) | Amount of Replenisher (ml/m$^2$) | Tank Capacity (liter) |
|---|---|---|---|---|
| Color Development | 38.5 | 45 | 70 | 500 |
| Bleach-fixing | 30 to 35 | 45 | 55 | 500 |
| Rinsing (1) | 30 to 35 | 20 | — | 200 |
| Rinsing (2) | 30 to 35 | 20 | — | 200 |
| Rinsing (3) | 30 to 35 | 20 | — | 200 |
| Rinsing (4) | 30 to 35 | 20 | — | 200 |
| Rinsing (5) | 30 to 35 | 20 | 300 | 200 |

(Rinsing was effected by countercurrent system from rinsing tank (5) to rinsing tank (1) in back order. Tank capacity of stock tank for overflow solution was 100 liter)

15000 m$^2$ of the above-mentioned photographic print material (8.9 cm width) was continuously processed over a period of 10 days, in accordance with each of the following three methods. In these method, an average carry-over amount was 57 ml/m$^2$. Precisely, each of the following tank solutions was filled in the processing tank before start of the continuous processing. After the process was started, the following replenisher was replenished when every 10 m$^2$ of the photographic materials were processed and the process was continued. In this connection, although the leader velts did not stop during the 10 days processing, the total time when the photographic materials were processed in the tank was 16 hours per day.

Test (1) (conventional method):

The replenisher was only replenished and overflow solution therefrom was discarded.

Test (2) (comparative method):

When the liquid level in the color developer tank become lower than 2 cm (corresponding to about 10 liters) below overflow holes which were positioned 10 cm from the upper level of the tank, water was added so as to maintain the standard liquid level (below the overflow holes).

Test (3) (method of the invention):

The overflowed solution from the color developer tank was stored in the stock tank, and when the liquid level in the color developer tank became lower than 2 cm (corresponding to about 10 liters) below overflow holes which were positioned 10 cm from the upper level of the tank, a overflow solution was supplied to the tank so that the liquid level of the tank was corrected to the standard level (below the overflow holes).

The processing solutions used in the test processes are mentioned below.

| | Fresh Tank Solution | Replenisher |
|---|---|---|
| Color Developer: | | |
| Triethanolamine | 10 g | 10 g |
| 1-Hydroxyethylidene-1,1-diphosphonic Acid (60 wt. %) | 2 g | 2 g |
| Diethylenetriamine-pentaacetic Acid | 1 g | 1 g |
| Nitrilo-N,N,N-trimethylene-phosphonic Acid (40 wt. %) | 8 g | 8 g |
| Potassium Chloride | 5.5 g | — |
| Potassium Bromide | 0.02 g | — |
| Hydrazino-diacetic Acid | 5 g | 7 g |
| N-ethyl-N-(β-methane-sulfonamidoethyl)-2-methyl-4-aminoaniline Sulfate | 5 g | 11 g |
| Brightening Agent (WHITEX 4, product by Sumitomo) | 1.25 g | 2.5 g |
| Potassium Carbonate | 25 g | 25 g |
| Sodium Sulfite | 0.1 g | — |
| Water to make | 1000 ml | 1000 ml |
| KOH to make | pH of 10.00 | pH of 11.00 |
| Bleach-fixing Solution: | | |
| Ammonium Thiosulfate (70 w/v %) | 110 ml | 220 ml |
| Ammonium Sulfite Monohydrate | 19.4 g | 38.8 g |
| EDTA | 1.5 g | 3.0 g |
| EDTA/Fe/$NH_4$ | 55 g | 110 g |
| Ammonium Bromide | 25 g | 50 g |
| Nitric Acid (67%) | 24.5 g | 49 g |
| Water to make | 1000 ml | 1000 ml |
| pH | 5.20 | 4.80 |

Rinsing Solution:

Ion-exchanged water (having calcium content of 3 ppm or less and magnesium content of 3 ppm or less).

In accordance with the above-mentioned Tests (1) to (3), photographic films of Fuji Color Paper Control Strips Super FA TYPE II (product by Fuji Photo Film Co.) were processed every day in order to evaluate the time-dependent variation of the photographic characteristics of the processed films, whereupon variation of the photographic characteristics of the films from the start time was obtained with respect to the variation of the sensitivity LD and that of gradation C. At the finish of the test, the total wate liquid amount from the color developer used was obtained.

The variation of the cyan density of the color image formed is shown in Table 2 below, where "+5" means that the density increased by 0.05 and the minus value indicates decrease of the density value.

The results obtained are shown in Table 2 below.

TABLE 2

| | Test (1) | | Test (2) | | Test (3)* | |
|---|---|---|---|---|---|---|
| Test Date | LD | C | LD | C | LD | C |
| 1 | 0 | 0 | 0 | 0 | 0 | 0 |
| 2 | −5 | +2 | −2 | −2 | −1 | +1 |
| 3 | −4 | +3 | −3 | −3 | −1 | +1 |
| 4 | −6 | +5 | −4 | −5 | −2 | +2 |
| 5 | −8 | +7 | −5 | −7 | −2 | +2 |
| 6 | −10 | +9 | −7 | −8 | −2 | +1 |
| 7 | −12 | +10 | −8 | −9 | −3 | +1 |
| 8 | −13 | +11 | −10 | −10 | −3 | +2 |
| 9 | −14 | +12 | −11 | −10 | −3 | +2 |
| 10 | −15 | +12 | −12 | −10 | −3 | +1 |
| Total Waste | 75 liters | | 153 liters | | 25 liters | |

Test (3)* is the example of the invention.

In Test (1), the liquid level gradually lowered and it lowered by about 50 liters after 10 days. As a result, air was engulfed into the circulation system so that the processing was at last impossible. Additionally, the processing solution was concentrated with progress of the process so that the sensitivity of the material processed lowered and the contrast thereof became hard. That is, the photographic properties of the materials processed in Test (1) worsened with the lapse of the processing time. In Test (2), the amount of the waste solution to be drained was extremely large since water was added to the processing tank. Additionally, since the working solution was diluted with water added, the sensitivity of the material processed lowered and the contrast thereof became soft. That is, the photographic properties of the materials processed in Test (2).

EXAMPLE 3: Fresh Tank Solution

Plural layers mentioned below were formed on a paper support both surfaces of which were coated with polyethylene, to prepare a multi-layer color photographic paper. The coating compositions used were prepared as mentioned below.

Preparation of First Layer-Coating Composition:

A 27.2 cc amount of ethyl acetate and 8.2 g of solvent (Solv-1) were added to 19.1 g of yellow coupler (ExY), 4.4 g of color image stabilizer (Cpd-1) and 0.7 g of color image stabilizer (Cpd-7) and dissolved. The resulting solution was dispersed by emulsification in 185 cc of an aqueous 10% gelatin solution containing 8 cc of 10% sodium dodecylbenzenesulfonate. An amount of $2.0\times10^{-4}$ mol per mol of silver of a blue-sensitive sensitizing dye mentioned below was added to a silver chlorobromide emulsion (containing cubic grains with a mean grain size of 0.82 micron and having a grain size distribution fluctuation coefficient of 0.08 and a silver bromide content of 0.2 mol % as a localized phase on the grain surface), and thereafter the emulsion was sulfur-sensitized. The previously prepared emulsified dispersion and the emulsion were blended to form a first layer-coating liquid having the composition mentioned below.

The other second layer-coating composition to seventh layer-coating composition were also prepared in the same manner as mentioned above. As a gelatin-hardening agent for each layer was used 1-hydroxy-3,5-dichloro-s-triazine sodium salt.

To the blue-sensitive emulsion layer, green-sensitive emulsion layer and red-sensitive emulsion layer was added 1-(5 -methylureidophenyl)-5-mercaptotetrazole, in an amount of $8.5\times10^{-5}$ mol, $7.7\times10^{-4}$ mol and $2.5\times10^{-4}$ mol, respectively, per mol of silver halide.

To the blue-sensitive emulsion layer and green-sensitive emulsion layer was added 4-hydroxy-6-methyl-1,3,3a,7-tetrazaindene in an amount of $1\times10^{-4}$ mol and $2\times10^{-4}$ mol, respectively, per mol of silver halide.

The following dyes were added to the emulsion layers for anti-irradiation.

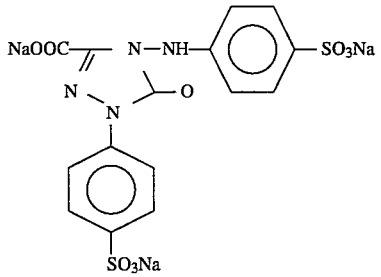

(7.1 mg per $m^2$ of photographic material)

and

-continued

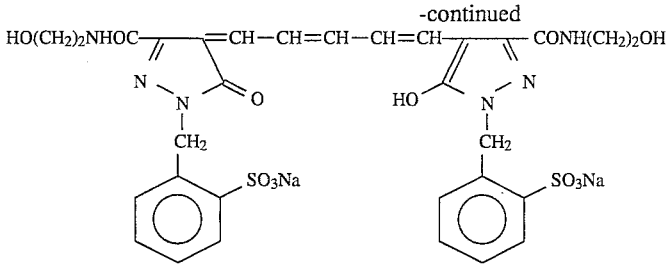

(14.7 mg per $m^2$ of photographic material)

and

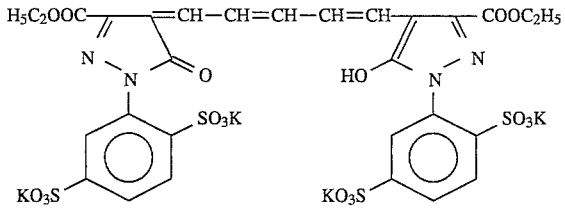

(36.2 mg per $m^2$ of photographic material)

Composition of Layers:

The composition of each layer is mentioned below. The number indicates the amount coated ($g/m^2$). The amount of silver halide emulsion coated is represented by the amount of silver therein.

| | |
|---|---|
| Support: | |
| Polyethylene-laminated paper (containing titanium oxide and blueish dye (ultramarine) in polyethylene coated with first layer) | |
| First Layer: Blue-sensitive Layer | |
| Above-mentioned Silver Chlorobromide Emulsion | 0.25 |
| Gelatin | 1.86 |
| Yellow Coupler (ExY) | 0.82 |
| Color Image Stabilizer (Cpd-1) | 0.19 |
| Solvent (Solv-1) | 0.35 |
| Color Image Stabilizer (Cpd-7) | 0.06 |
| Second Layer: Color Mixing Preventing Layer | |
| Gelatin | 0.99 |
| Color Mixing Preventing Agent (Cpd-5) | 0.08 |
| Solvent (Solv-1) | 0.16 |
| Solvent (Solv-4) | 0.08 |
| Third Layer: Green-sensitive Layer | |
| Silver Chlorobromide Emulsion (containing cubic grains with mean grain size of 0.40 micron and having fluctuation coefficient of grain size distribution of 0.08 and AgBr content of 0.8 mol % as localized phase on the grain surface) | 0.12 |
| Gelatin | 1.24 |
| Magenta Coupler (BxM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer: Ultraviolet Absorbtion Layer | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |
| Fifth Layer: Red-sensitive Layer | |

-continued

| | |
|---|---|
| Silver Chlorobromide Emulsion (containing cubic grains with mean grain size of 0.60 micron and having fluctuation coefficient of grain size distribution of 0.09 and AgBr content of 0.6 mol % as localized phase partly on the surface grain) | 0.20 |
| Gelatin | 1.34 |
| Cyan Coupler (BxC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer: Ultraviolet Absorbing Layer | |
| Gelatin | 0.53 |
| Ultraviolet Absorbent (UV-1) | 0.16 |
| Color Mixing Preventing Agent (Cpd-5) | 0.02 |
| Solvent (Solv-5) | 0.08 |
| Seventh Layer: Protective Layer | |
| Gelatin | 1.33 |
| Acryl-modified Copolymer of Polyvinyl Alcohol (with modification degree of 17%) | 0.17 |
| Liquid Paraffin | 0.03 |

Compounds used above are as follows:

Yellow Coupler (ExY):
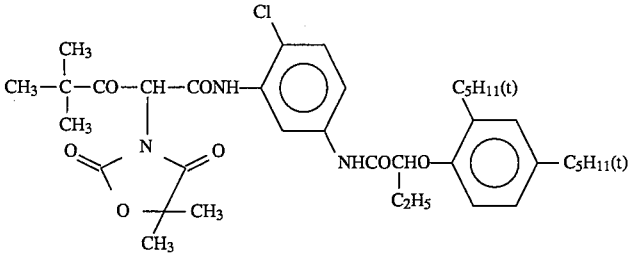
Cyan Coupler (ExC):
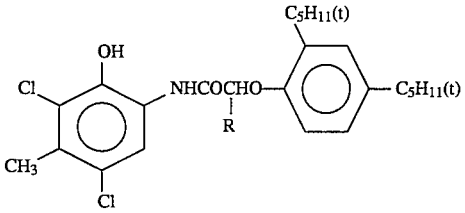
(R = $C_2H_5$, $C_4H_9$ and 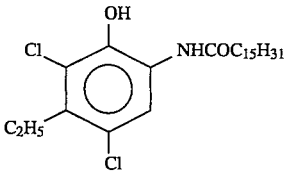 of 2/4/4, by weight)
Color Image Stabilizer (Cpd-1):
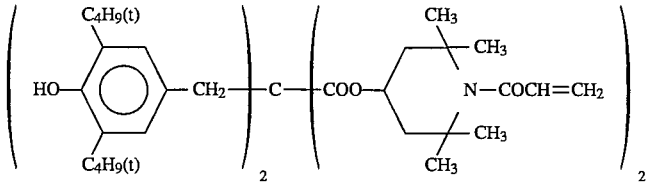
Color Image Stabilizer (Cpd-2):
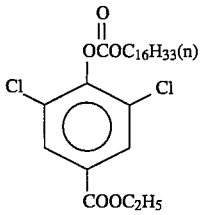
Color Image Stabilizer (Cpd-3):
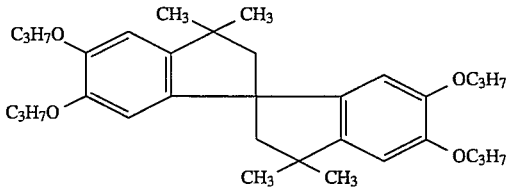

-continued
Color Image Stabilizer (Cpd-4):
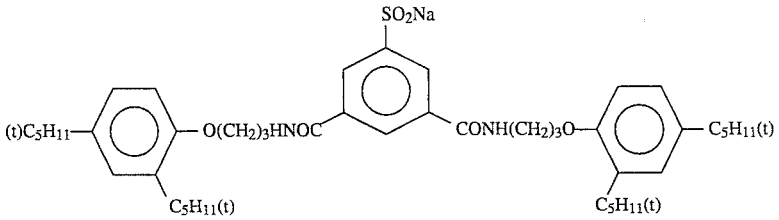
Color Mixing Preventing Agent (Cpd-5):
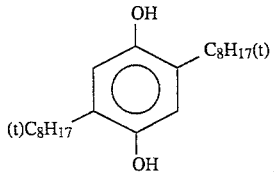
Color Image Stabilizer (Cpd-6): Mixture (2/4/4, by weight) of the following compounds.
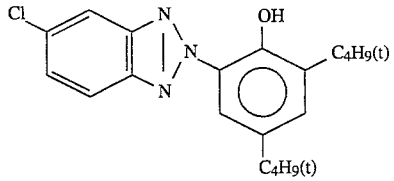
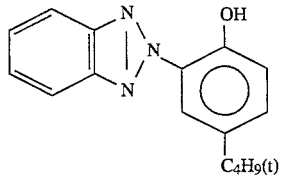
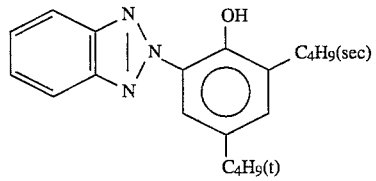
Color Image Stabilizer (Cpd-7):
$$\left(CH_2-\underset{\underset{CONHC_4H_9(t)}{|}}{CH}\right)_n$$
(mean molecular weight: 60,000)
Color Image Stabilizer (Cpd-8): Mixture (1/1, by weight) of the following compounds.
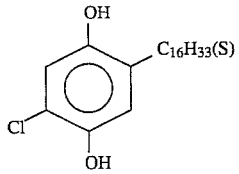

-continued
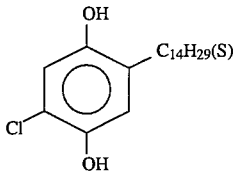
Color Image Stabilizer (Cpd-9):
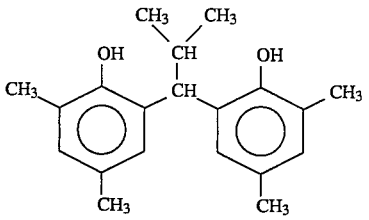
Ultraviolet Absorbent (UV-1): Mixture (4/2/4, by weight) of the following compounds.
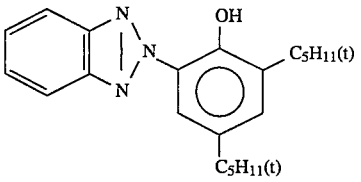
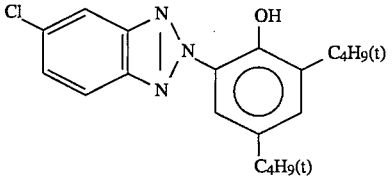
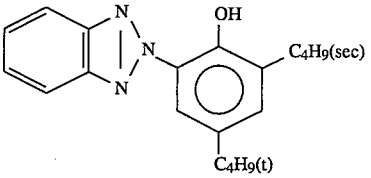
Solvent (Solv-1):
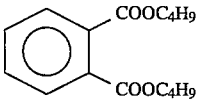
Solvent (Solv-2): Mixture (2/1, by volume) of the following compounds.
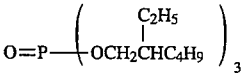
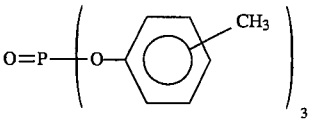

-continued

Solvent (Solv-4):

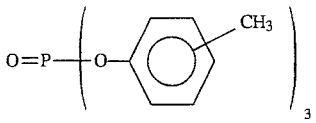

Solvent (Solv-5):

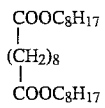

Solvent (Solv-6): Mixture (95/5, by volume) of the following compounds.

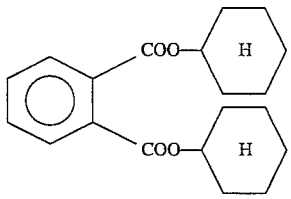

As color sensitizing dyes for each layer were used the following compounds.

Green-sensitive Emulsion Layer:

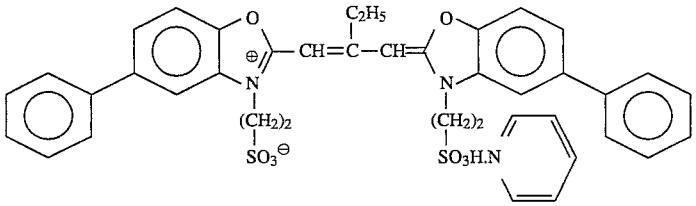

This compound was added to the emulsion, in an amount of $4.0\times10^{-4}$ mol per mol of silver halide to a large-size emulsion and $5.6\times10^{-4}$ mol per mol of silver halide to a small-size emulsion.

and

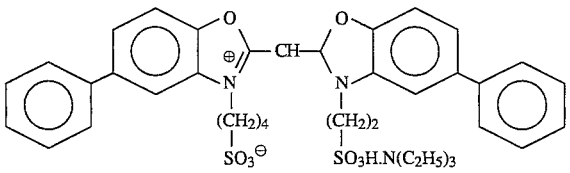

This compound was added to the emulsion, in an amount of $7.0\times10^{-5}$ mol per mol of silver halide to a large-size emulsion and $1.0\times10^{-5}$ mol per mol of silver halide to a small-size emulsion.

Blue-sensitive Emulsion Layer:

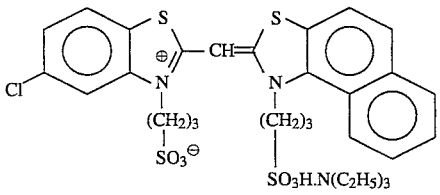

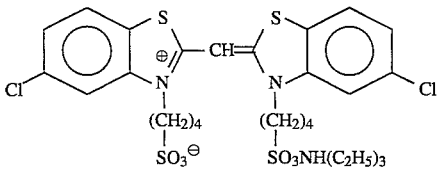

These compounds were added to the emulsion, individually in an amount of $2.0\times10^{-4}$ mol per mol of silver halide to a large-size emulsion and $2.5\times10^{-4}$ mol per mol of silver halide to a small-size emulsion.

Red-sensitive Emulsion Layer:

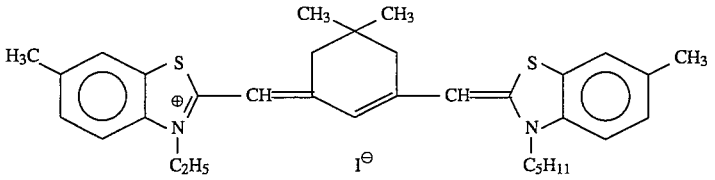

This compound was added to the emulsion, in an amount of $0.9\times10^{-4}$ mol per mol of silver halide to a large-size emulsion and $1.1\times10^{-4}$ mol per mol of silver halide to a small-size emulsion.

To the red-sensitive emulsion layer was added the following compound in an amount of $2.6\times10^{-2}$ mol per mol of silver halide.

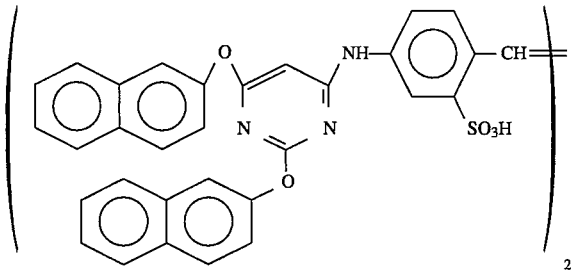

To each of the blue-sensitive emulsion layer, green-sensitive emulsion layer and red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, respectively, per mol of silver halide.

To each of the blue-sensitive emulsion layer and green-sensitive emulsion layer was added 4-hydroxy-6-methyl-1,3,3a,7-tetrazaindene in an amount of $1\times10^{-4}$ mol and $2\times10^{-4}$ mol, respectively, per mol of silver halide.

The following dyes were added to each emulsion layer for the purpose of anti-irradiation.

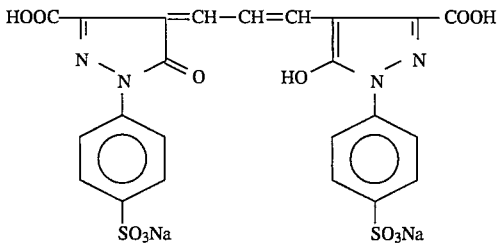

and

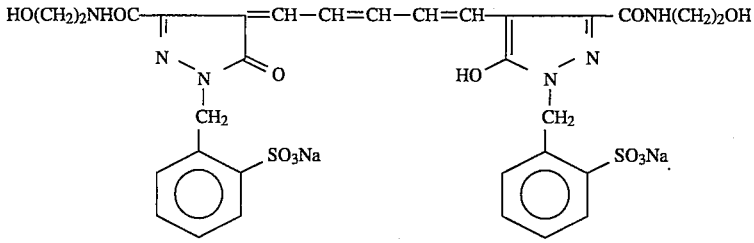

The sample thus prepared was called Sample (III-1).

Next, other Samples (III-2) to (III-5) were prepared in the same manner as above, except that the silver halide composition in each emulsion layer was varied as indicated below.

| Sample No. | Blue-sensitive Layer | Green-sensitive Layer | Red-sensitive Layer |
|---|---|---|---|
| III-1 | 99.8 | 99.2 | 99.4 |
| III-2 | 95.7 | 95.1 | 95.3 |
| III-3 | 90.1 | 90.3 | 90.3 |
| III-4 | 85.1 | 85.5 | 85.4 |
| III-5 | 79.8 | 80.1 | 80.2 |

The number in Table above indicates the silver chloride content in each silver chlorobromide emulsion, as mol %.

As the processing machine was used a partly modified Fuji Color Paper Processor FPRP202L (manufactured by Fuji Photo Film Co.), which is as follows:

Linear Velocity: 2 m/min

Leader Belt Conveyance System:

Using two leader belts, at most four lines of photographic papers can be processed at a time.

Sample (III-1) was imagewise exposed and then continuously processed with the above-mentioned processing machine, in accordance with the process mentioned below.

| Processing Step | Temperature (°C.) | Time (sec) | Amount of Replenisher (ml/m²) | Tank Capacity (liter) |
|---|---|---|---|---|
| Color Development | 39.0 | 45 | 55 | 50 |
| Bleach-fixing | 30 to 35 | 45 | 55 | 50 |
| Rinsing (1) | 30 to 35 | 20 | — | 20 |
| Rinsing (2) | 30 to 35 | 20 | 150 | 20 |
| Water-washing (1) | 30 to 35 | 20 | — | 20 |
| Water-washing (2) | 30 to 35 | 20 | — | 20 |
| Water-washing (3) | 30 to 35 | 20 | 4000 | 20 |

(Rinsing was effected by countercurrent system from rinsing (2) to rinsing (1); an water-washing was effected also by countercurrent system from water-washing (3) to water-washing (1) in back order.)

1900 $m^2$ of the above-mentioned photographic print material sample was continuously processed over a period of 10 days, in accordance with each of the following three methods, where the tank solution and the replenisher were made different from each other in the same way as in Example 1.

Test (4) (comparative method):

When the liquid level in the color developer tank lowered, water was added so as to compensate and correct the liquid level.

Test (5) (method of the invention):

When the liquid level in the color developer tank lowered, a fresh tank solution was added to the tank so that the liquid level of the tank was corrected to the predetermined level.

The processing solutions used in the test processes are mentioned below.

| Color Developer: | Fresh Tank Solution | Replenisher |
|---|---|---|
| Triethanolamine | 10 g | 10 g |
| Ethylenediamine-tetraacetic Acid | 3 g | 3 g |
| Catechol-3,5-disulfonic Acid | 0.3 g | 0.3 g |
| N,N-di(phosphonoethyl) hydroxylamine | 5.0 g | 10.0 g |
| Potassium Chloride | 6.7 g | — |
| Potassium Bromide | 0.03 g | — |
| N-ethyl-N-(β-methane-sulfonamidoethyl)-3-methyl-4-aminoaniline Sulfate | 5 g | 13 g |
| Brightening Agent (WHITEX 4, product by Sumitomo Chemical) | 1.25 g | 3.0 g |
| Potassium, Carbonate | 25 g | 25 g |
| Water to make | 1000 ml | 1000 ml |
| KOH to make | pH of 10.00 | pH of 11.20 |

The same bleach-fixing solution as that in Example 1 was used. As the rinsing solution and water-washing solution, a city water was used.

In accordance with the above-mentioned Tests (4) and (5), Samples (III-1) to (III-5) were wedgewise exposed and then processed once per two days in order to evaluate the time-dependent variation of the photographic characteristics of the processed samples, whereupon variation of the photographic characteristics of the processed samples from the start time was obtained. Precisely, the variation of the photographic characteristics, if any, was represented by the amount of the variation of the density of the part which had a density of 1.0 at the start time. The amount of the variation of the cyan density thus obtained was shown in Table 3 below.

TABLE 3

| Process | Sample | Test Date (day) 0 | 2 | 4 | 6 | 8 | 10 |
|---|---|---|---|---|---|---|---|
| Test (4) | III-1 | 0 | −2 | −5 | −8 | −10 | −11 |
| | III-2 | 0 | −2 | −5 | −8 | −10 | −11 |
| | III-3 | 0 | −2 | −5 | −8 | −10 | −12 |
| | III-4 | 0 | −2 | −6 | −8 | −11 | −12 |
| | III-5 | 0 | −2 | −6 | −9 | −11 | −12 |
| Test (5) (method of the invention) | III-1 | 0 | 0 | 0 | −1 | −1 | −1 |
| | III-2 | 0 | 0 | 0 | −1 | −1 | −1 |
| | III-3 | 0 | 0 | −1 | −2 | −2 | −2 |
| | III-4 | 0 | −2 | −3 | −4 | −5 | −5 |
| | III-5 | 0 | −2 | −3 | −4 | −5 | −5 |

In accordance with the processing method of the present invention, the photographic characteristics of the photographic materials as processed continuously are extremely stable. In particular, the effect of the present invention is remarkable in the Samples (III-1), (III-2) and (III-3) each having high-silver chloride emulsions.

Example 4: Overflow Solution

The following samples were made in the identical manner as Example 3.

| Sample No. | Blue-sensitive Layer | Green-sensitive Layer | Red-sensitive Layer |
|---|---|---|---|
| IV-1 | 99.8 | 99.2 | 99.4 |
| IV-2 | 95.7 | 95.1 | 95.3 |
| IV-3 | 90.1 | 90.3 | 90.3 |
| IV-4 | 85.1 | 85.5 | 85.4 |
| IV-5 | 79.8 | 80.1 | 80.2 |

(The number in Table above indicates the silver chloride content in each silver chlorobromide emulsion, as mol %.)

Sample (IV-1) was imagewise exposed and then continuously processed in accordance with the process mentioned below, using the same processor as that used in Example 2.

| Processing Step | Temperature (°C.) | Time (sec) | Amount of Replenisher (ml/m²) | Tank Capacity (liter) |
|---|---|---|---|---|
| Color Development | 39.0 | 45 | 65 | 500 |
| Bleach-fixing | 30 to 35 | 45 | 55 | 500 |
| Rinsing (1) | 30 to 35 | 20 | — | 200 |
| Rinsing (2) | 30 to 35 | 20 | 150 | 200 |
| Water-washing (1) | 30 to 35 | 20 | — | 200 |
| Water-washing (2) | 30 to 35 | 20 | — | 200 |
| Water-washing (3) | 30 to 35 | 20 | 4000 | 200 |

(Rinsing was effected by countercurrent system from rinsing (2) to rinsing (1); and water-washing was effected also by countercurrent system from water-washing (3) to water-washing (1) in back order.)

15000 $m^2$ of the above-mentioned photographic print material sample was continuously processed over a period of 10 days, in accordance with each of the following three methods, where the tank solution and the replenisher were made different from each other in the same way as in Example 2.

Test (4): When the liquid level in the color developer tank lowered, water was added so as to maintain the standard liquid level.

Test (5): The overflowed solution from the color developer tank was stored in the stock tank, and when the liquid level in the color developer tank lowered, the processing solution (stock solution) from the stock tank was replenished to the color developer tank so that the liquid level of the color developer tank was corrected to the determined one.

The processing solutions used in the test processes are mentioned below.

| Color Developer: | Fresh Tank Solution | Replenisher |
|---|---|---|
| Triethanolamine | 10 g | 10 g |
| Ethylenediamine-tetraacetic Acid | 3 g | 3 g |
| Catechol-3,5-disulfonic Acid | 0.3 g | 0.3 g |
| N,N-di(phosphonoethyl) hydroxylamine | 5.0 g | 9.0 g |
| Potassium Chloride | 6.0 g | — |
| Potassium Bromide | 0.03 g | — |
| N-ethyl-N-(β-methane-sulfonamidoethyl)-3-methyl-4-aminoaniline Sulfate | 5 g | 12 g |
| Brightening Agent (WHITEX 4, product by Sumitomo) | 1.25 g | 3.0 g |
| Potassium Carbonate | 25 g | 25 g |
| Sodium Sulfite | 0.1 g | — |
| Water to make | 1000 ml | 1000 ml |
| KOH to make | pH of 10.00 | pH of 11.00 |

The same bleach-fixing solution as that in Example 2 was used. As the rinsing solution and water-washing solution, a city water was used.

In accordance with the above-mentioned Tests (4) and (5), Samples (IV-1) to (IV-5) were wedgewise exposed and then processed once per two days in order to evaluate the time-dependent variation of the photographic characteristics of the processed samples, whereupon variation of the photographic characteristics of the processed samples from the start time was obtained. Precisely, the variation of the photographic characteristics, if any, was represented by the amount of the variation of the density of the part which had a density of 1.0 at the start time. The amount of the variation of the magenta density thus obtained was shown in Table 4 below. Additionally, the total amount of the waste liquid from the color developer used was measured in every test case.

TABLE 4

| Process | Sample | Test Date (day) 0 | 2 | 4 | 6 | 8 | 10 | Amount of Waste Liquid (liter) |
|---|---|---|---|---|---|---|---|---|
| Test (4) | IV-1 | 0 | −3 | −7 | −10 | −12 | −13 | 74 |
| | IV-2 | 0 | −4 | −7 | −10 | −12 | −13 | |
| | IV-3 | 0 | −4 | −8 | −11 | −13 | −14 | |
| | IV-4 | 0 | −4 | −8 | −11 | −13 | −14 | |
| | IV-5 | 0 | −4 | −7 | −11 | −13 | −14 | |
| Test (4) method of the invention) | IV-1 | 0 | −1 | −1 | −1 | −1 | −2 | 5 |
| | IV-2 | 0 | −1 | −1 | −2 | −2 | −2 | |
| | IV-3 | 0 | −1 | −1 | −2 | −2 | −2 | |
| | IV-4 | 0 | −3 | −4 | −5 | −6 | −6 | |
| | IV-5 | 0 | −3 | −4 | −5 | −6 | −7 | |

In accordance with the processing method of the present invention, the amount of the waste liquid from the method may noticealy be reduced, and the photographic characteristics of the photographic materials as processed continuously are extremely stable. In particular, the effect of the present invention is remarkable in the Samples (IV-1), (IV-2) and (IV-3) each having high-silver chloride emulsions.

Example 5 Fresh Tank Solution

Plural layers mentioned below were formed on a paper support both surfaces of which were coated with polyethylene and were treated by corona-discharge treatment, to prepare a multi-layer color photographic paper. The coating compositions used were prepared as mentioned below.

Preparation of First Layer-Coating Composition:

An amount of 150 cc of ethyl acetate, 1.0 cc of solvent (Solv-3) and 3.0 cc of solvent (Solv-4) were added to 60.0 g of yellow coupler (ExY) and 28.0 g of anti-fading agent (Cpd-1) and dissolved. The resulting solution was then added to 450 cc of an aqueous 10% gelatin solution containing sodium dodecylbenzenesulfonate and dispersed with an ultrasonic homogenizer. The resulting dispersion was blended with 420 g of a silver chlorobromide emulsion (silver bromide content: 0.7 mol %) containing the following blue-sensitizing dye, to prepare a first layer-coating composition.

The other second layer-coating composition to seventh layer-coating composition were also prepared in the same manner as mentioned above. The compound 1,2 bis(vinylsulfonyl)ethane was used as a gelatin-hardening agent for each layer.

The following color-sensitizing dyes were added to each layer.

Blue-sensitive Emulsion Layer:

Anhydro-5,5'-dichloro-3,3'-disulfoethylthiacyanine hydroxide

Green-sensitive Emulsion Layer:

Anhydro-9-ethyl-5,5'-diphenyl-3,3'-disulfoethyloxacarbocyanine hydroxide

Red-sensitive emulsion Layer:

3,3'-Diethyl-5-methoxy-9,11-neopentylthiadicarbocyanine iodide

A mixture (7/2/1, by mol) of 1-(2-acetaminophenyl)-5-mercaptotetrazole, 1-phenyl-5-mercaptotetrazole and 1-(p-methoxyphenyl)- 5-mercaptotetrazole was used as a stabilizer.

The following were used as anti-irradaition dyes: Disodium [3-carboxy-5-hydroxy-4-(3-(3-carboxy-5-oxo-1-( 2,5-bisulfonatophenyl)-2-pyrazolin-4-ylidene)-1-propenyl) -1-pyrazolyl] benzene-2,5-disulfonate; Tetrasodium N,N'-(4,8 -dihydroxy-9,10-dioxo-3,7-disulfonatoanthracene-1,5-diyl)bis(aminomethanesulfonate); Sodium [3-cyano-5 -hydroxy-4-(3-(3-cyano-5-oxo-l-(4-sulfonatophenyl)-2 -pyrazolin-4-ylidene)-1-pentanyl)-1-pyrazolyl] benzene-4 -sulfonate.

Constitution of Layers:

The composition of each layer is mentioned below. The number indicates the amount coated (g/m$^2$). The amount of silver halide emulsion coated is represented by the amount of silver therein.

Support:

Paper support both surfaces of which were coated with polyethylene and were treated by corona-discharge treatment.

| First Layer: Blue-sensitive Layer | |
|---|---|
| Above-mentioned Silver Chlorobromide Emulsion (AgBr 0.7 mol %; cubic grains with mean grain size of 0.9 micron) | 0.30 |
| Gelatin | 1.80 |
| Yellow Coupler (ExY) | 0.60 |
| Anti-fading Agent (Cpd-1) | 0.28 |

-continued

| | |
|---|---|
| Solvent (Solv-3) | 0.01 |
| Solvent (Solv-4) | 0.03 |
| Second Layer: Color Mixing Preventing Layer | |
| Gelatin | 0.80 |
| Color Mixing Preventing Agent (Cpd-2) | 0.055 |
| Solvent (Solv-1) | 0.03 |
| Solvent (Solv-2) | 0.015 |
| Third Layer: Green-sensitive Layer | |
| Above-mentioned Silver Chlorobromide Emulsion (AgBr 0.7 mol %; cubic grains with mean grain size of 0.45 micron) | 0.20 |
| Gelatin | 1.86 |
| Magenta Coupler (ExM) | 0.27 |
| Anti-fading Agent (Cpd-3) | 0.17 |
| Anti-fading Agent (Cpd-4) | 0.10 |
| Solvent (Solv-1) | 0.20 |
| Solvent (Solv-2) | 0.03 |
| Fourth Layer: Color Mixing Preventing Layer | |
| Gelatin | 1.70 |
| Color Mixing Preventing Agent (Cpd-2) | 0.065 |
| Ultraviolet Absorbent (UV-1) | 0.45 |
| Ultraviolet Absorbent (UV-2) | 0.23 |
| Solvent (Solv-1) | 0.05 |
| Solvent (Solv-2) | 0.05 |
| Fifth Layer: Red-sensitive Layer | |
| Above-mentioned Silver Chlorobromide Emulsion (AgBr 0.4 mol %; cubic grains with mean grain size of 0.5 micron) | 0.20 |
| Gelatin | 1.80 |
| Cyan Coupler (ExC-1) | 0.26 |
| Cyan Coupler (ExC-2) | 0.12 |
| Anti-fading Agent (Cpd-1) | 0.20 |
| Solvent (Solv-1) | 0.16 |
| Solvent (Solv-2) | 0.09 |
| Coloration Accelerator (Cpd-5) | 0.15 |
| Sixth Layer: Ultraviolet Absorbing Layer | |
| Gelatin | 0.70 |
| Ultraviolet Absorbent (UV-1) | 0.26 |
| Ultraviolet Absorbent (UV-2) | 0.07 |
| Solvent (Solv-1) | 0.30 |
| Solvent (Solv-2) | 0.09 |
| Seventh layer: Protective Layer | |
| Gelatin | 1.07 |

Compounds used above are as follows:

Anti-fading Agent (Cpd-1):

$$-(CH_2-CH)_n-$$

$CONHCH_4H_9(n)$—(mean molecular weight: 80,000)

Color Mixing Preventing Agent (Cpd-2):
2,5-Di-tert-octylhydroquinone

Anti-fading Agent (Cpd-3):
7,7'-Dihydroxy-4,4,4',4'-tetramethyl-2,2'-spirochromane Anti-fading Agent (Cpd-4):
N-(4-dodecyloxyphenyl)-morpholine Coloration Accelerator (Cpd-5):
P-(p-toluenesulfonamido)phenyl-dodecane Solvent (Solv-1):
Di(2-ethylhexyl) Phthalate Solvent (Solv-2):
Dibutyl Phthalate Solvent (Solv-3):
Di(i-nonyl) Phthalate Solvent (Solv-4):
N,N-diethylcarbonamido-methoxy-2,4-di-t-amylbenzene Ultraviolet Absorbent (UV-1):
2-(2-Hydroxy-3,5-di-tert-amylphenyl)benzotriazole Ultraviolet Absorbent (UV-2):
2-(2-Hydroxy-3,5-di-tert-butylphenyl)benzotriazole Yellow Coupler (ExY):

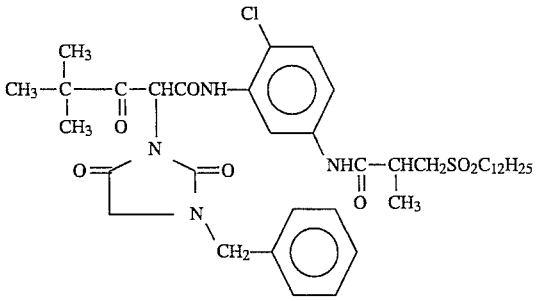

-continued

Magenta Coupler (ExM):

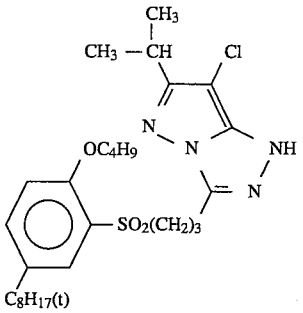

Cyan Coupler (ExC):

ExC-1:

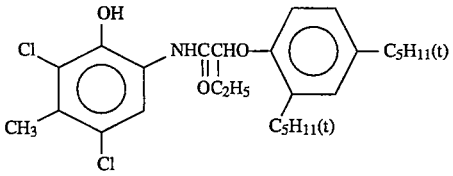

ExC-2:

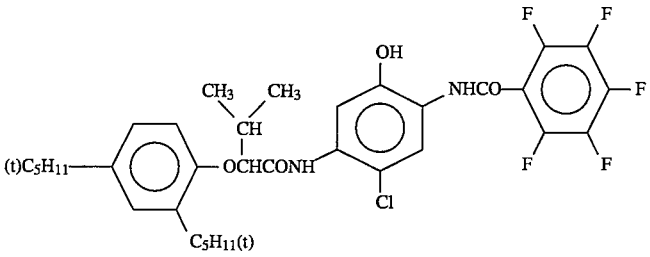

The sample thus prepared was called Sample (V-A). Next, other Samples (V-B), (V-C), (V-D) and (V-E) were prepared in the same manner as above, except that the amount of silver in each layer coated was varied as indicated below.

| | Amount of Silver Coated ($g/m^2$) | | | |
|---|---|---|---|---|
| Sample | 1st layer | 3rd layer | 5th layer | total |
| V-A | 0.30 | 0.20 | 0.20 | 0.70 |
| V-B | 0.32 | 0.22 | 0.21 | 0.75 |
| V-C | 0.35 | 0.22 | 0.23 | 0.80 |
| V-D | 0.35 | 0.24 | 0.26 | 0.85 |
| V-E | 0.37 | 0.25 | 0.30 | 0.92 |

Sample (V-A) was imagewise exposed and then continuously processed in accordance with the same process of using the same processing machine as in Example 2.

Precisely, 2000 $m^2$ of Sample (V-A) was imagewise exposed and then continuously processed over a period of 20 days, in accordance with each of the following two methods.

Test (6) (comparative method):

When the liquid level in the color developer tank lowered, water was added so as to compensate and correct the liquid level.

Test (7) (method of the invention):

When the liquid level in the color developer tank lowered, a fresh tank solution was added to the tank so that the liquid level of the tank was corrected to the predetermined level.

The processing solutions used in the test processes are mentioned below.

| Color Developer: | Fresh Tank Solution | Replenisher |
|---|---|---|
| Triethanolamine | 10 g | 10 g |
| 1-Hydroxytethylidene-1,1-diphosphonic Acid (69%) | 2 g | 2 g |
| Lithium Sulfate | 1 g | 1 g |
| Potassium Chloride | 5.7 g | — |
| Potassium Bromide | 0.03 g | — |
| N-ethyl-N-(β-methanesulfonamidoethyl)-3-methyl-4-aminoaniline Sulfate | 4.5 g | 12 g |
| Brightening Agent (UVITEX CK, product by Ciba-Geigy) | 1.0 g | 2.0 g |
| Potassium Carbonate | 25 g | 25 g |
| Water to make | 1000 ml | 1000 ml |
| KOH to make | pH of 10.00 | pH of 11.20 |

The same bleach-fixing solution, rinsing solution and water-washing solution as those in Example 3 were used.

In accordance with the above-mentioned tests (6) and (7), Samples (V-A), (V-B), (V-C), (V-D) and (V-E) were wedgewise exposed and then processed once per two days in order to evaluate the time-dependent variation of the photographic characteristics of the processed samples, whereupon variation of the photographic characteristics of the processed samples from the start time was obtained. Precisely, the variation of the photographic characteristics, if any, was represented by the amount of the variation of the density of the part which had a density of 1.0 at the start time. The amount of variation of the magenta density thus obtained was shown in Table 5 below.

TABLE 5

| | | Test Date (day) | | | | | |
|---|---|---|---|---|---|---|---|
| Process | Sample | 0 | 2 | 4 | 6 | 8 | 10 |
| Test (6) | V-A | 0 | −4 | −6 | −9 | −11 | −12 |
| | V-B | 0 | −4 | −6 | −9 | −11 | −12 |
| | V-C | 0 | −4 | −7 | −10 | −11 | −12 |
| | V-D | 0 | −4 | −7 | −10 | −12 | −13 |
| | V-E | 0 | −5 | −7 | −10 | −12 | −13 |
| Test (7) (method of the invention) | V-A | 0 | 0 | 0 | +1 | +1 | +1 |
| | V-B | 0 | 0 | +1 | +2 | +2 | +2 |
| | V-C | 0 | 0 | +2 | +3 | +3 | +3 |
| | V-D | 0 | +1 | +3 | +4 | +6 | +6 |
| | V-E | 0 | +2 | +3 | +4 | +6 | +6 |

In accordance with the processing method of the present invention, fluctuation of the sensitivity of the photographic material samples processed was small and stable. In particular, the effect of the present invention is remarkable in processing Samples (V-A), (V-B) and (V-C) having a silver content of 0.8 g or less.

In accordance with the method of the present invention, the amount of the waste solution to be drained from the processing machine may be noticeably reduced or eliminated, while the photographic characteristics of the photographic materials processed may be maintained to be stable.

In particular, the method of the present invention is effective for stable processing of high-silver chloride color photographic materials.

What is claimed is:

1. A method for continuous processing of a silver halide photographic material comprising passing a belt for conveying an imagewise exposed silver halide photographic material through a plurality of processing tanks including a development tank, carrying such a silver halide photographic material on the belt, and processing the material in the processing tanks while replenishing the processing tanks with constant amounts of replenishing solution per unit area of silver halide photographic material, wherein the constant amounts of replenishing solution range from 30 to 100 $ml/m^2$ of the photographic material to be processed, and wherein the method further comprises detecting a level of processing solution in at least one of the processing tanks and supplying the at least one processing tank with additional processing solution when the level of processing solution falls to a predetermined level corresponding to a drop in the level of the development tank of 1% to 20% of the capacity of the development tank.

2. A method of claim 1 wherein the processing tank is a color development tank.

3. A method of claim 2 wherein the constant amount of replenishing solution for the development tank is not more than mean carry-over amount of the developing solution and the level of the developing solution in the development tank is detected.

4. A method of claim 2 wherein the photographic material is a silver halide color photographic material comprising a high-silver chloride emulsion.

5. A method of claim 4 wherein the high-silver chloride emulsion consists of a silver halide emulsion containing not less than 80 mole % of silver chloride and not more than 1.0% of silver iodide.

6. A method of claim 5 wherein the high-silver chloride emulsion consists of a silver halide emulsion containing 98 to 99.9 mole % of silver chloride.

7. A method of claim 4 wherein the color photographic material is developed in the development tank, desilvered in a desilvering tank, washed with water in water-washing tanks and/or stabilized in stabilizing tanks while continuously replenishing the tanks with constant amounts of replenishing solutions respectively, and a level of developing solution in the development tank is detected to supply the development tank with an additional replenishing solution when said level of developing solution falls to a predetermined level.

8. A method of claim 1 wherein the predetermined level comprises a level corresponding to a drop in the level of the development tank of 2% to 10% of the capacity of the development tank.

9. A method of claim 1 wherein the additional processing solution is a fresh tank solution, formulation of which is the same as that charged in the tank at the starting time of the processing.

10. A method of claim 1 wherein overflow solution overflowing from the development tank is collected, the overflow solution is stored in a stock tank and the overflow solution is used as the additional processing solution.

11. A method of claim 10 wherein the replenishing solution is replenished to the development tank in an amount of 20–80 $ml/m^2$ of the photographic material to be processed.

12. A method of claim 10 wherein the predetermined level comprises a level corresponding to a drop in the level of the development tank of 2% to 10% of the capacity of the development tank.

13. A method of claim 10 wherein the photographic material is a silver halide color photographic material comprising a high-silver chloride emulsion and the development tank is a color development tank.

14. A method of claim 13 wherein the high-silver chloride emulsion consists a silver halide emulsion containing not less than 80 mole % of silver chloride and not more than 1.0% of silver iodide.

15. A method of claim 14 wherein the high-silver chloride emulsion consists a silver-halide emulsion containing 98 to 99.9 mole % of silver chloride.

16. A method of claim 13 wherein the color photographic material is developed in the development tank, desilvered in a desilvering tank, washed with water in water-washing tanks and/or stabilized in stabilizing tanks while replenishing the tanks with constant amounts of replenishing solutions respectively, and overflow solution overflowing from the development tank is collected, the overflow solution is stored in a stock tank and a level of developing solution in the development tank is detected to supply the development tank with an the overflow solution from the stock tank when the level of developing solution falls to a predetermined level.

* * * * *